US008210955B2

(12) United States Patent
Yule

(10) Patent No.: US 8,210,955 B2
(45) Date of Patent: Jul. 3, 2012

(54) AMUSEMENT RIDE SYSTEM

(75) Inventor: Lance Yule, Portland, ME (US)

(73) Assignee: StarFlight Amusement Rides, LLC, Portland, ME (US)

( * ) Notice: Subject to any disclaimer, the term of this patent is extended or adjusted under 35 U.S.C. 154(b) by 208 days.

(21) Appl. No.: 12/615,678

(22) Filed: Nov. 10, 2009

(65) Prior Publication Data

US 2010/0173717 A1 Jul. 8, 2010

Related U.S. Application Data

(63) Continuation-in-part of application No. 11/936,199, filed on Nov. 7, 2007, now Pat. No. 7,896,752.

(51) Int. Cl.
*A63H 23/02* (2006.01)
*A63H 23/00* (2006.01)

(52) U.S. Cl. ..... 472/129; 472/134; 104/23.2

(58) Field of Classification Search ..... 472/13, 472/128, 129, 135; 180/117–118, 123–124; 104/23.2

See application file for complete search history.

(56) References Cited

U.S. PATENT DOCUMENTS

| | | | | |
|---|---|---|---|---|
| 2,174,716 | A | 10/1929 | Bethell | |
| 3,142,285 | A | 7/1964 | Sorrentino et al. | |
| 3,251,595 | A | 5/1966 | Morgan et al. | |
| 4,292,758 | A | 10/1981 | Kuna et al. | |
| 5,613,443 | A * | 3/1997 | Ariga et al. | 104/70 |
| 6,045,449 | A | 4/2000 | Aragona et al. | |
| 6,115,974 | A | 9/2000 | Milanian | |
| 7,854,663 | B2 * | 12/2010 | Burger | 472/129 |
| 2006/0169508 | A1 | 8/2006 | Trojahn | |
| 2007/0144796 | A1 | 6/2007 | Schaedler et al. | |
| 2009/0118024 | A1 | 5/2009 | Yule | |

FOREIGN PATENT DOCUMENTS

| | | |
|---|---|---|
| EP | 0 252 752 | 1/1988 |
| WO | WO 2009/061923 | 5/2009 |

OTHER PUBLICATIONS

International Search Report and Written Opinion; PCT/US2010/055785; B.R. Copenheaver; Jan. 26, 2011.
International Search Report for PCT Application No. PCT/US2008/082642 (mailed Feb. 24, 2009).

* cited by examiner

*Primary Examiner* — Kien Nguyen
(74) *Attorney, Agent, or Firm* — Fish & Richardson P.C.

(57) ABSTRACT

An amusement ride vehicle for maneuvering over a travel surface having a cushion of water includes a vehicle body defining a vehicle undersurface disposed for travel generally along the travel surface and at least one drive assembly housed by the vehicle body. The at least one drive assembly comprises a driven wheel disposed for selective engagement with the travel surface to maneuver the vehicle generally along the travel surface. The at least one drive assembly operates between a neutral state having the driven wheel disengaged from the travel surface, a forward drive state having the driven wheel engaged with the travel surface and driven in a forward direction, and a reverse drive state having the driven wheel engaged with the travel surface and driven in a reverse direction.

21 Claims, 29 Drawing Sheets

AMUSEMENT RIDE SYSTEM

CROSS REFERENCE TO RELATED APPLICATIONS

This U.S. patent application is a continuation-in-part of, and claims priority under 35 U.S.C. §120 from, U.S. patent application Ser. No. 11/936,199, filed on Nov. 7, 2007, which is hereby incorporated by reference in its entirety.

TECHNICAL FIELD

This disclosure relates to amusement ride systems, and, in particular, to amusement ride systems having fluid-supported vehicles.

BACKGROUND

Amusement rides may include vehicles or other devices for transporting people over water. These amusement ride systems generally include watercraft vehicles designed to float along with or upon a confined body of water, transporting one or more passengers. The body of water may be stationary or moving. For example, in a log flume amusement ride, a vehicle resembling a log moves along a narrow, flowing channel of water. The watercraft vehicles may also have the form of bumper boats, consisting of an inner-tube shaped watercraft, with steerable gas or electric motor, that drivers try to ram into other boats as they travel past.

SUMMARY

According to one aspect of the disclosure, an amusement ride vehicle for maneuvering over a travel surface having a cushion of water includes a vehicle body defining a vehicle undersurface disposed for travel generally along the travel surface and at least one drive assembly housed by the vehicle body. The at least one drive assembly comprises a driven wheel disposed for selective engagement with the travel surface to maneuver the vehicle generally along the travel surface. The at least one drive assembly operates between a neutral state having the driven wheel disengaged from the travel surface, a forward drive state having the driven wheel engaged with the travel surface and driven in a forward direction, and a reverse drive state having the driven wheel engaged with the travel surface and driven in a reverse direction.

Implementations of the disclosure may include one or more of the following features. The at least one drive assembly comprises a pivot link pivotally coupled to the vehicle body with the driven wheel mounted on the pivot link. Rotation or pivoting of the pivot link changes an operation state of the at least one drive assembly. In some examples, the at least one drive assembly includes a pivot link pivotally coupled to the vehicle body and defining a substantially V-shaped receiver configured to receive an engagement feature of a respective steering element. The driven wheel is mounted on the pivot link. Rotation or pivoting of the steering element moves the engagement feature along the substantially V-shaped receiver, causing rotation or pivoting of the pivot link and changing an operation state of the at least one drive assembly. The wheel can concentrically mounted about a motor for rotation about the motor.

In some implementations, the amusement ride vehicle includes a passenger seat having a back support portion disposed at an angle forward off vertical of between about 5° and about 40° (preferably about)10°, for shifting a center of gravity of a user substantially near or over the vertical center of the vehicle. In some implementations, the undersurface of the vehicle body includes an edge portion having an edge surface arranged at an angle with the undersurface of between about 10° and about 60° (preferably about)30°.

According to another aspect of the disclosure, an amusement ride vehicle for maneuvering over a travel surface having a cushion of water includes a vehicle body defining a vehicle undersurface disposed for travel generally along the travel surface, right and left joysticks pivotally coupled to the vehicle body for rotation or pivoting between forward, neutral, and rearward positions, and right and left drive assemblies associated with the respective right and left joysticks. The right and left drive assemblies are housed by the vehicle body and configured to maneuver the vehicle generally along the travel surface. Each drive assembly includes a pivot link pivotally coupled to the vehicle body, and a driven wheel disposed on the pivot link for selective engagement with the travel surface. The pivot link defines a substantially V-shaped receiver configured to receive an engagement feature of the respective joystick. Each drive assembly operates between a neutral state having the driven wheel disengaged from the travel surface, a forward drive state having the driven wheel engaged with the travel surface and driven in a forward direction, and a reverse drive state having the driven wheel engaged with the travel surface and driven in a reverse direction, rotation or pivoting of the respective joystick moves the engagement feature along the substantially V-shaped receiver, causing rotation or pivoting of the pivot link and changing an operation state of the respective drive assembly.

Implementations of the disclosure may include one or more of the following features. In some implementations, the wheel is concentrically mounted about a motor for rotation about the motor. The amusement ride vehicle may include a passenger seat having a back support portion disposed at an angle forward off vertical of between about 5° and about 40° (preferably about)10°, for shifting a center of gravity of a user substantially over the vertical center of the vehicle. In some examples, the undersurface of the vehicle body includes an edge portion having an edge surface arranged at an angle with the undersurface of between about 10° and about 60° (preferably about)30°.

According to another aspect of the disclosure, a method of conveying an amusement ride vehicle generally along a travel surface includes placing the vehicle on an amusement ride infrastructure defining the travel surface. The vehicle includes a vehicle body defining a vehicle undersurface disposed for travel generally along the travel surface. The method includes delivering a pressurized flow of water through the travel surface into a confined region defined between the vehicle undersurface and the travel surface. The pressurized flow of water into and through the confined region creates a cushion of water to separate the vehicle undersurface from the travel surface. The method also includes maneuvering the vehicle over the travel surface by manipulating a steering element to alter an operation state of at least one drive assembly housed by the vehicle body. The at least one drive assembly includes a driven wheel disposed for selective engagement with the travel surface to maneuver the vehicle generally along the travel surface. The at least one drive assembly operates between a neutral state having the driven wheel disengaged from the travel surface, a forward drive state having the driven wheel engaged with the travel surface and driven in a forward direction, and a reverse drive state having the driven wheel engaged with the travel surface and driven in a reverse direction.

Implementations of the disclosure may include one or more of the following features. In some implementations, the method includes pivoting a pivot link of the at least one drive assembly to change an operation state of the at least one drive assembly, the driven wheel mounted on the pivot link. The method may include rotating or pivoting a steering element having an engagement feature received by a substantially V-shaped receiver defined by the pivot link. Rotation or pivoting of the steering element moves the engagement feature along the substantially V-shaped receiver, causing rotation or pivoting of the pivot link and changing an operation state of the at least one drive assembly. In some implementations, the method includes positioning a user in a passenger seat having a back support portion disposed at an angle forward off vertical of between about 5° and about 40° (preferably about) 10°, for shifting a center of gravity of the user substantially over the vertical center of the vehicle.

In some implementations, the pressurized flow of water is delivered through a plurality of selectively disposed supply valves. Each supply valve of the plurality of supply valves includes a supply valve body defining at least one inlet port, an exit port, and an interior surface defining a water flow passageway between the at least one inlet port and the exit port and a valve seat. The exit port is exposed at the travel surface. A supply valve element is disposed within the water flow passageway for movement between a first position in sealing engagement with the valve seat and a second position spaced from the valve seat for permitting pressurized flow of water through the exit port. A supply valve element operator extends above a plane of the travel surface in a position for contact with a vehicle passing over the exit port. Vehicle contact with the supply valve element operator causes movement of the supply valve element from the first position to the second position, permitting pressurized flow of water through the exit port into the confined region defined between the vehicle undersurface and the travel surface. In some examples, the method includes maneuvering the vehicle along the travel surface through at least one themed region of the amusement ride infrastructure.

According to yet another aspect of the disclosure, an amusement ride system includes an amusement ride infrastructure defining a travel surface; at least one vehicle having a vehicle body defining a vehicle undersurface disposed for travel generally along the travel surface; and a plurality of supply valves disposed to selectively deliver a pressurized flow of water through the travel surface, into a confined region defined between the vehicle undersurface and the travel surface. The pressurized flow of water into and through the confined region creates a cushion of water to separate the vehicle undersurface from the travel surface. The vehicle is configured to convey at least one passenger generally along the travel surface, upon the cushion of water.

In another aspect, an amusement ride vehicle for maneuvering over a travel surface having a cushion of water includes a vehicle body defining a vehicle undersurface disposed for travel generally along the travel surface, and at least one drive assembly housed by the vehicle body and configured to maneuver the vehicle generally along the travel surface.

In yet another aspect, an amusement ride infrastructure includes a surface layer defining a travel surface and a plurality of supply valves disposed in the surface layer. Each supply valve includes a supply valve body defining an exit port, at least one inlet port, and an interior surface defining a water flow passageway between the at least one inlet port and the exit port and a valve seat. The exit port is exposed at the travel surface. A supply valve element is disposed within the water flow passageway for movement between a first position in sealing engagement with the valve seat and a second position spaced from the valve seat for permitting pressurized flow of water through the exit port. A supply valve element operator extends above a plane of the travel surface in a position for contact with a vehicle (e.g., vehicle undersurface) passing over the exit port. Vehicle contact with the supply valve element operator causes movement of the supply valve element from the first position to the second position, permitting pressurized flow of water through the exit port into a confined region defined between an undersurface of the vehicle and the travel surface.

In another aspect, a method of conveying an amusement ride vehicle generally along a travel surface includes placing the vehicle on an amusement ride infrastructure defining the travel surface. The vehicle includes a vehicle body that defines a vehicle undersurface disposed for travel generally along the travel surface. The method includes delivering a pressurized flow of water through the travel surface into a confined region defined between the vehicle undersurface and the travel surface. The pressurized flow of water into and through the confined region creates a cushion of water to separate the vehicle undersurface from the travel surface. The method also includes maneuvering the vehicle over the travel surface. In some implementations, the pressurized flow of water is delivered through a plurality of selectively disposed valves. The method may include shifting a center of gravity of a user substantially near or over the vertical center of the vehicle, as by angling the back support portion of a passenger seat forward, thereby moving the user's torso over or toward the center of the vehicle. In some examples the method includes maneuvering the vehicle along the travel surface through at least one themed region of the amusement ride infrastructure. The method may include abutting together support layer sections and applying a surface treatment, such as a porous or non-porous thermoplastic aliphatic rubber, to the support layer sections for providing a contiguous travel surface.

Implementations of the disclosure may include one or more of the following features. Each supply valve includes a supply valve body defining an exit port, at least one inlet port, and an interior surface defining a water flow passageway between the at least one inlet port and the exit port and a valve seat, with the exit port being exposed at the travel surface. A supply valve element is disposed within the water flow passageway for movement between a first position in sealing engagement with the valve seat and a second position spaced from the valve seat for permitting pressurized flow of water through the exit port. A supply valve element operator extends above a plane of the travel surface in a position for contact with a vehicle passing over the exit port. Vehicle contact with the supply valve element operator causes movement of the supply valve element from the first position to the second position, permitting pressurized flow of water through the exit port into the confined region defined between the vehicle undersurface and the travel surface. The valve element is urged toward sealing engagement with the valve seat by water pressure in the water flow passageway, and/or by a biasing element, e.g. a spring.

The amusement ride infrastructure may include at least one drain valve disposed to drain water from the travel surface. The drain valve includes a drain valve body defining an exit port, at least one inlet port, and an interior surface defining a water flow passageway between the at least one inlet port and the exit port and a valve seat. The exit port is exposed at the travel surface. A drain valve element is disposed within the water flow passageway for movement between a first position in sealing engagement with the valve seat and a second position spaced from the valve seat for permitting flow of water through the exit port. In some implementations, the supply valve body houses the drain valve. For example, the supply valve body defines the drain valve body. In some implementations, the drain valve element is buoyant and moves between the first and second positions by buoyancy. In additional implementations, the drain valve element is biased (e.g., via a spring) toward the second position and water pressure from the cushion of water under a vehicle passing there over causes the drain valve element to move to the first position in sealing engagement with the valve seat.

The vehicle includes at least one drive assembly housed by the vehicle body and configured to maneuver the vehicle generally along the travel surface. In some implementations, the drive assembly includes a driven wheel disposed for engagement with the travel surface. The drive assembly rotates about an axis normal to the travel surface. The drive assembly includes a drive housing and a driven wheel supported by the drive housing operable for movement among a retracted position and a deployed position at least partially below or relatively more extended below the vehicle undersurface and disposed for engagement with the travel surface. The driven wheel is spring biased toward its deployed position.

In some implementations, a lower portion of the vehicle body includes a reservoir and the vehicle undersurface defines at least one aperture in fluid communication with the reservoir cavity, wherein fluid from the cushion of water enters the reservoir cavity through the aperture. The drive assembly includes at least one pump disposed in the vehicle body. The pump has an inlet line in fluid communication with the reservoir cavity and/or the aperture and an outlet line configured to discharge below the vehicle undersurface in a manner to propel the vehicle generally along the travel layer. In some instances, the pump has an inlet line in fluid communication with the reservoir cavity and an outlet line configured to discharge fluid under pressure behind the vehicle for propelling the vehicle generally along the travel surface.

The vehicle includes at least one compliant flap extending from the vehicle body and generally circumscribing the confined region defined between the vehicle undersurface and the travel surface. The compliant flap serves to augment creation of the cushion of water separating the vehicle undersurface from the travel surface. The compliant flap may comprise multiple flap elements.

The vehicle undersurface encompasses an area of at least about three valves. A valve spacing along the travel surface that provides this minimum number of valves under the vehicle insures that the valves can provide enough fluid (e.g. water) to create a fluid layer sufficient to support the vehicle and allow the vehicle to glide along the travel surface. Valve spacing along the travel surface may be modified based on a fluid flow rate through the valves to provide a fluid layer having a thickness that provides a specified minimum distance (e.g. ¼ inch) between the bottom of the vehicle and the travel surface.

The vehicle may also include a bumper disposed along at least one side region of the vehicle body. In a preferred implementation, the bumper wraps around every side of the vehicle, which may be used as a bumper car in an amusement park ride. In some examples, a water gun is mounted on the vehicle body for spraying other ride patrons or spectators. The water gun is in fluid communication with a fluid pump disposed in the vehicle body.

In some implementations, the vehicle further includes a passenger seat having a back support portion disposed at an angle ($\beta$) forward off vertical of between about 5° and about 40°, and in particular about 10°, for shifting a center of gravity of a user substantially near or over the vertical center of the vehicle. In some examples, the undersurface of the vehicle body includes an edge portion having an edge surface arranged at an angle ($\phi$) with the undersurface of between about 10° and about 60°, and in particular about 30°.

The amusement ride infrastructure may include at least one themed region with the travel surface extending into the at least one themed region for access by the at least one vehicle. Examples of themed regions include a jungle themed region, a tropical themed region, a city themed region; a space themed region, a forest themed region, and/or a pinball game themed region. In some implementations, the amusement ride infrastructure comprises abutting support layer sections and a surface treatment applied to the support layer sections providing a contiguous travel surface. In some examples, the surface treatment comprises application of a thermoplastic aliphatic rubber.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
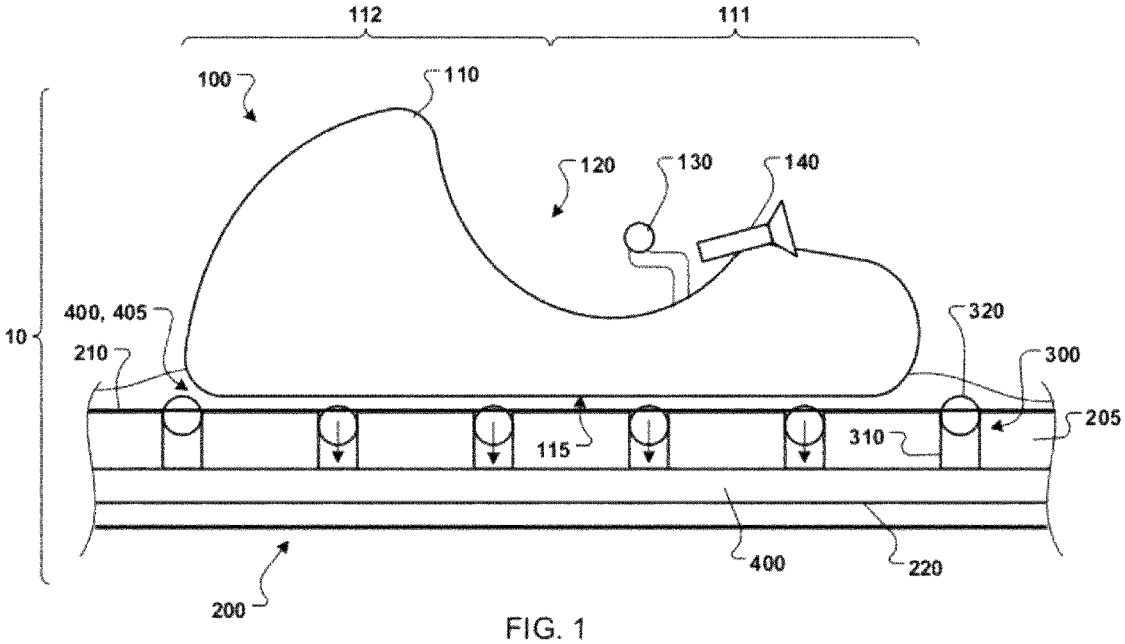
FIG. 1 is a side view of an amusement ride system.
Figure 2:
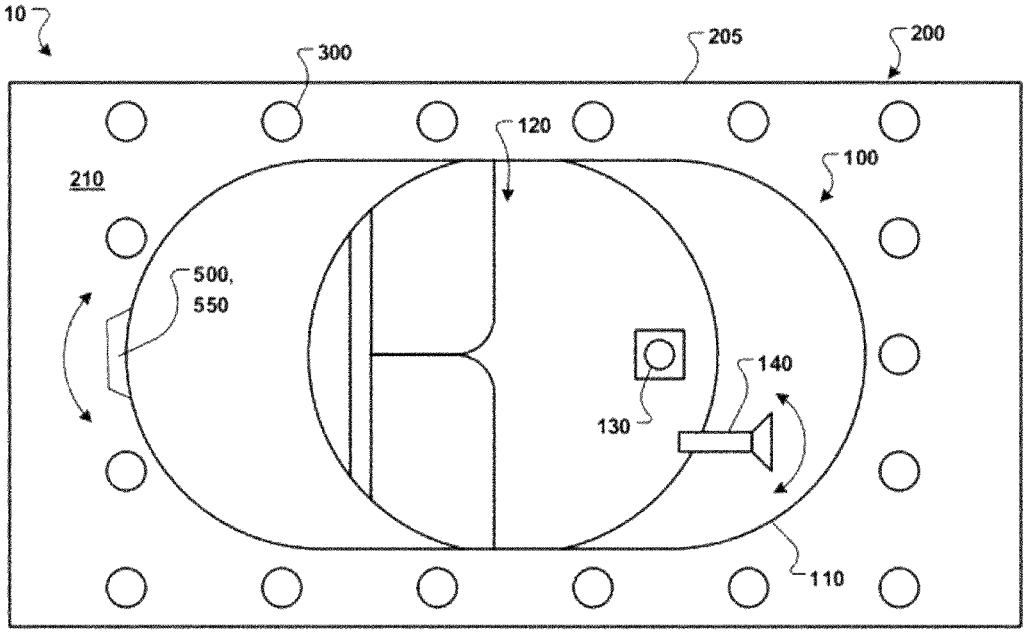
FIG. 2 is a top view of an amusement ride system.

An amusement park ride system utilizes a custom infrastructure for travel of novel vehicles about or upon a track, each vehicle conveying one or more passengers generally along a travel surface, riding upon a cushion of water. A plurality of valves mounted to extend through the travel surface are actuated during travel of a vehicle over the valves to deliver a pressurized flow of water into a confined region defined between the vehicle undersurface and the travel surface. The pressurized flow of water into and through the confined region creates a cushion of water to separate the vehicle undersurface from the travel surface. The vehicle is thus configured to convey at least one passenger generally along the travel surface upon the cushion of water.

Turning now to the drawings, and with particular reference initially to FIGS. 1-4, an amusement ride system 10 includes one, or preferably more, vehicles 100, each having a forward portion 111 (bow) and a rearward portion 112 (stern), supported by an amusement ride infrastructure 200 that includes a support layer 205 defining a travel surface 210. Each vehicle 100 has a body 110 that defines a passenger compartment 120 configured to hold one or more passengers. The body 110 may be rectangular or elliptical, preferably circular, in shape from a top view. An undersurface 115 of the vehicle body 110 is at least partially supported by a cushioning layer 405 of fluid 400, typically water, provided at the travel surface 210 of the support layer 205. In some examples, the cushion layer 405 of fluid 400 is about ¼ inch thick. The fluid 400 may be liquid or gaseous (e.g. water or air). In the examples shown the fluid 400 comprises water. The vehicle 100 moves generally along the travel surface 210 by sliding, gliding and/or hydroplaning upon the fluid layer 405 on the travel surface 210. The fluid layer 405 also provides lubricity between the undersurface 115 of the vehicle body 110 and the travel surface 210 of the support layer 205. When air is used for the fluid, the vehicle 100 floats on the cushion 405 of air 400. When water is used for the fluid, the vehicle 100 buoyantly floats on the cushion 405 of water 400.

Figure 5:
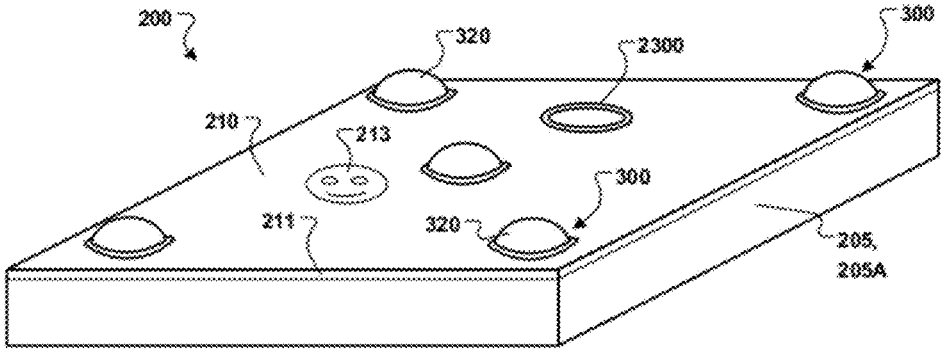
FIG. 5 is a perspective view of a travel surface of an amusement ride infrastructure.
Figure 6:
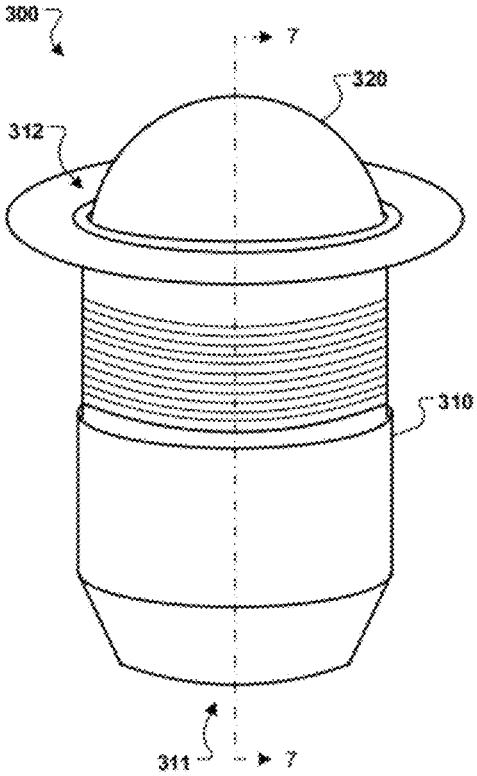
FIG. 6 is a perspective view of a supply valve.
Figure 7:
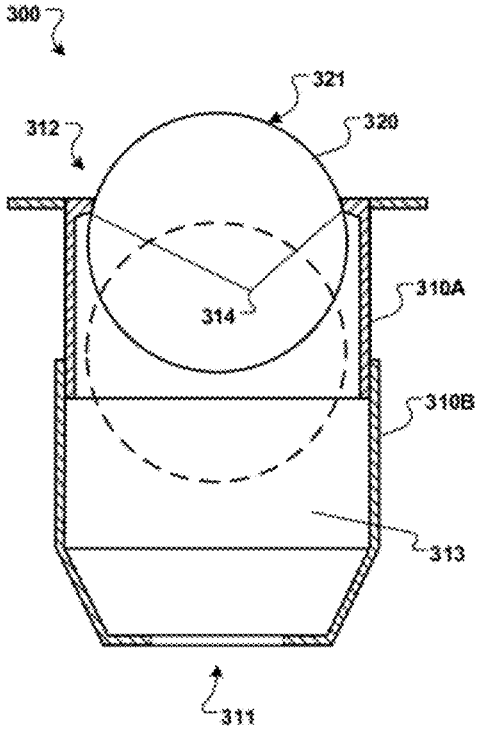
FIG. 7 is a sectional view of the valve shown in FIG. 6.

Referring to FIGS. 5-7, the infrastructure 200 includes a plurality of supply valves 300 disposed to extend through the support layer 205, to the travel surface 210. The support layer 205 may be the combination of several interconnected, interchangeable support layer sections 205A (as shown in FIG. 5). In some examples, the support layer sections 205A are 4 feet by 4 feet and include four, five, or more regularly distributed valves 300 (e.g. in an "X" pattern). Each end of the support layer section 205A is releasably attached or abutted to an opposed end of an adjacent support layer section 205A, allowing a user to create a support layer 205 of custom size and/or custom shape. When the support layer 205 is elevated above a ground surface and supported by scaffolding or support beams, the support layer 205 may be placed on the support beams at an angle (e.g., of between about 45° and about 90°) with respect to the beams, so that the beams run diagonally or perpendicular under the support layer 205, between rows of valves 300. The diagonal placement of the support beams aids deflection prevention of the support layer 205. In some implementations, once the support layer sections 205A have been arranged or assembled together to create the support layer 205 a surface treatment 211 is applied to the support layer 205 to provide an even and contiguous travel surface 210. For example, a porous or non-porous thermoplastic aliphatic rubber (e.g., Pebble-Flex™ available by Pebble-Flex, LLC, 1 Field Street, Avon, N.J. 07717, USA) may be applied or bonded to the support layer 205. The applied surface treatment 211 may be resistant to chlorine, skid resistant (e.g., in accordance to an ASTM E303 Skid Resistance Test), provide a foot friendly surface (e.g., soft), provide traction, be stable to light exposure, and/or be fade resistant (e.g., resistant to ultra-violet light). The surface treatment 211 may be applied to provide a level travel surface 210 with an uppermost point of each valve body, thereby to facilitate gliding of the vehicle(s) 100 over the support layer 205. The surface treatment 211 may also seal the cracks between abutting support layer sections 205A, thereby preventing premature escapement of water 400 from the travel surface 210. The surface treatment 211 may also be applied in a manner that provides graphics or images 213 on the travel surface 210. For example, after arranging several support layer sections 205A together, the surface treatment 211 may be applied in a manner that provides a contiguous travel surface 210 having graphics or images 213 and optionally being applied level. The graphics or images 213 may include a driving course, advertisements, decorations, and/or custom graphical illustrations.

Each valve 300 includes a valve body 310 defining at least one inlet port 311, an exit port 312, and an interior water flow passageway 313 between the inlet port(s) 311 and the exit port 312. The water flow passageway 313 defines a valve seat 314 near the exit port 312. The exit port 312 is exposed at the travel surface 210 of the support layer 205. In some examples, the valve body 310 includes upper and lower body portions 310A and 310B, respectively, disposed in fluid communication. For example, the lower body portion 310B defines female threads and the upper body portion 310A defines male threads, such that the upper body portion 310A is received by and threads into the lower body portion 310B. A valve element 320 is disposed within the water flow passageway 313 for movement among a first position in sealing engagement with the valve seat 314 and a second position spaced from the valve seat 314, permitting pressurized flow of water through the water flow passageway 313 defined by the valve body 310, and onto the travel surface 210 (into a region defined between the travel surface 210 and the undersurface 115 of a passing vehicle 100, as described more fully below). A valve element operator 321 (in one example, a portion of the valve element 320 protruding above the travel surface 210) extends through the exit port 312 and beyond the valve body 310 for actuating engagement by passing vehicles 100, again as described more fully below. The valve element 320 may be spherical, elliptical, cylindrical, cubical, pyramidal, or any other suitable shape.

The valve element 320 may be urged toward its first position in engagement with the valve seat 314 by water pressure in the water flow passageway 313. Alternatively, in the example of FIG. 8, the valve 300 includes a spring 330 biasing the valve element 320 into sealing engagement with the valve seat 314, causing the valve 300 to remain closed while not actuated. A combination of water pressure and biasing element 330 may also be employed.

Referring to FIGS. 8-10C, a fluid supply line 240 is in fluid communication with the valves 300, 1300 and delivers pressurized fluid 400 (water) to the valves 300, 1300. The fluid supply line 240 is generally routed below the support layer 205. The valve body 1310 may define a quick-disconnect feature 1319 configured to be received by a mating quick-disconnect fitting 1390 in fluid communication with the fluid supply line 240.

Figure 8:
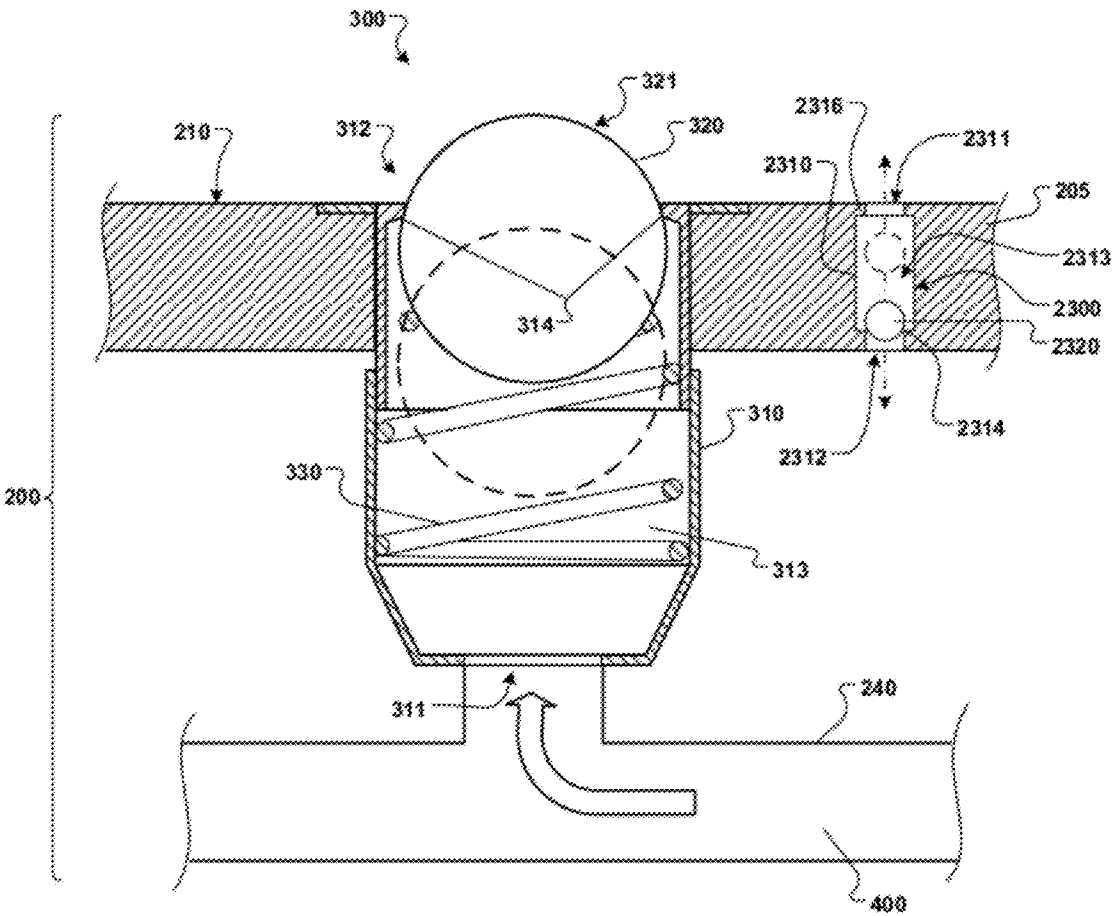
FIG. 8 is a sectional view of a travel surface and valve assemblies of an amusement ride system.
Figure 10A:
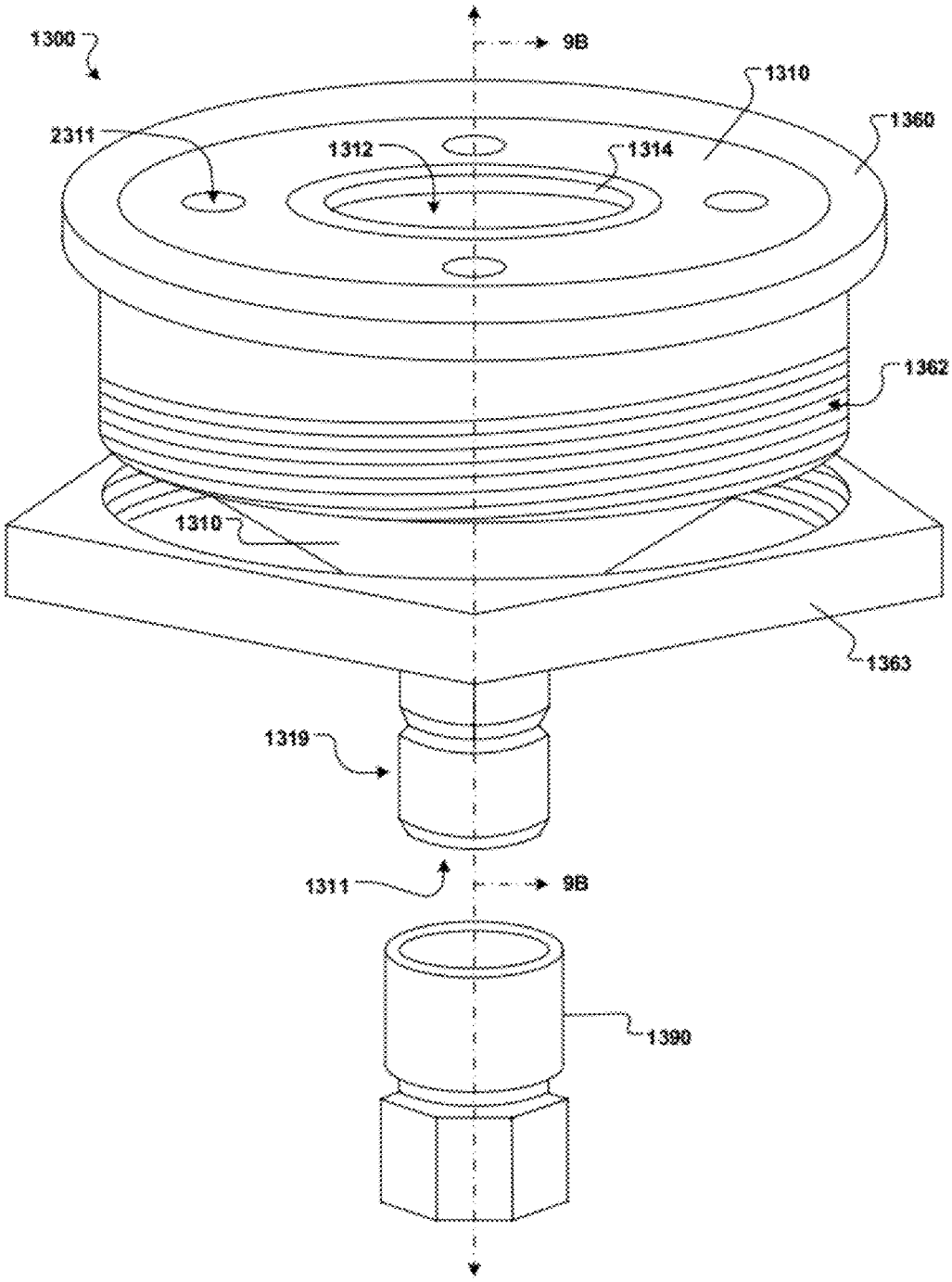
FIG. 10A is a perspective view of a supply valve having drain valves.
Figure 10B:
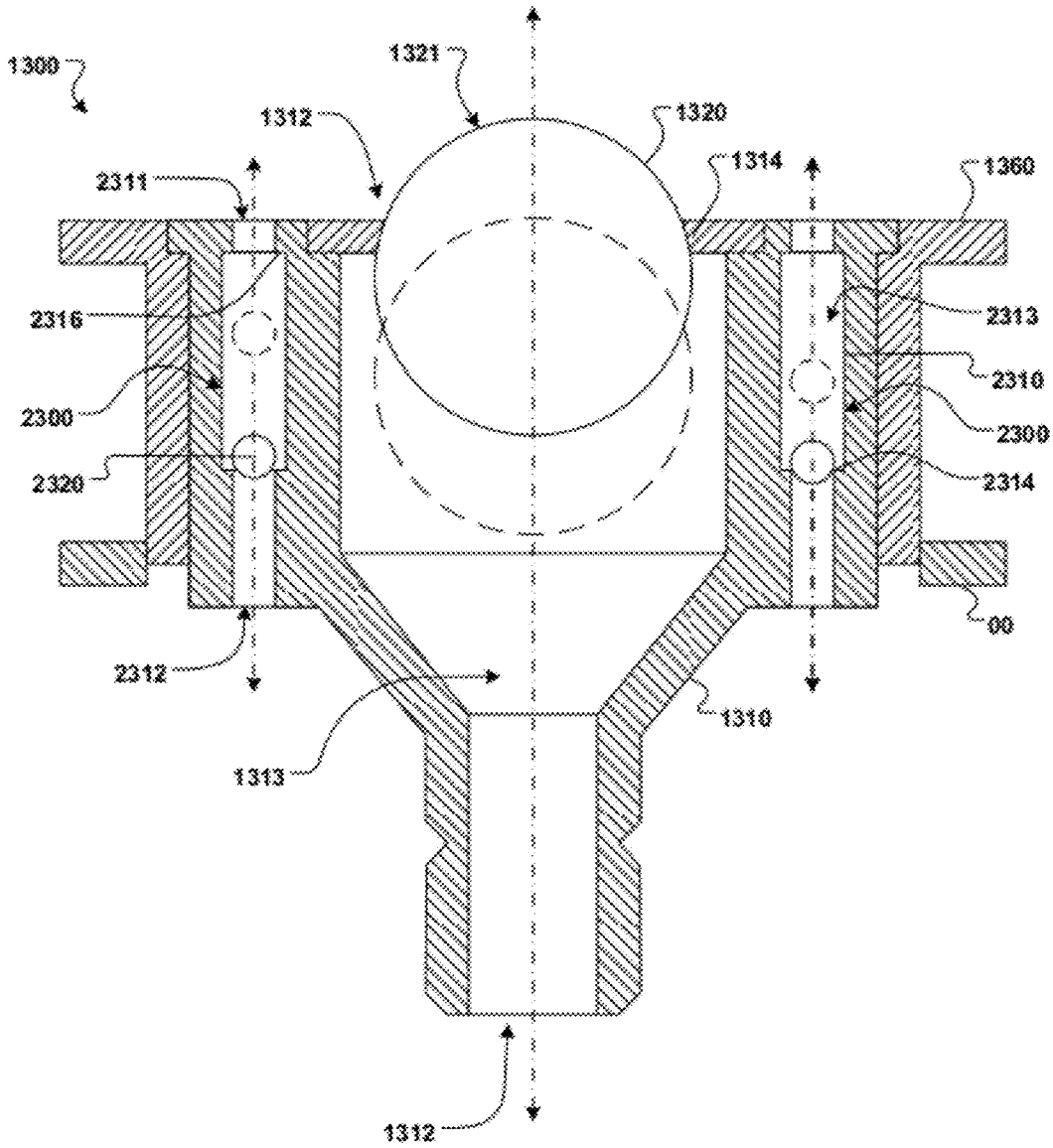
FIG. 10B is a sectional view of the valve shown in FIG. 10A.
Figure 10C:
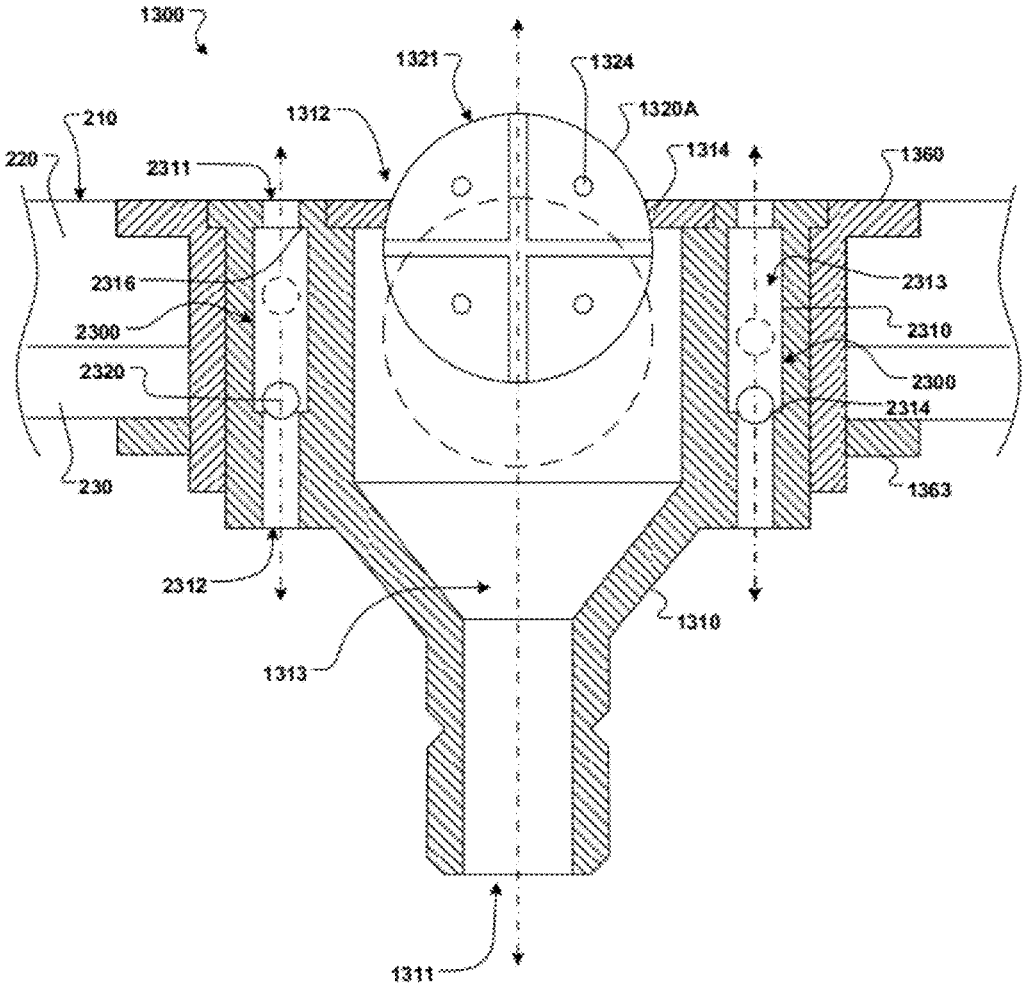
FIG. 10C is a sectional view of a supply valve.

In some implementations, the support layer 205 includes at least one drain valve 2300, as shown in FIG. 8; and/or the valve 1300 includes at least one drain valve 2300, as shown in FIGS. 10A-10C. The drain valve(s) 2300 may be located adjacent the supply valves 300, 1300, or in the case of being incorporated into the supply valve 300, 1300, defined by the supply valve bodies 1310, as shown in FIGS. 10A-10C. In examples where the supply valve 300 is separate from the drain valve 2300, at least one drain valve may be disposed on a support layer section 205A for draining water supplied by the adjacent supply valves 300 (see FIG. 5).

Figure 9A:
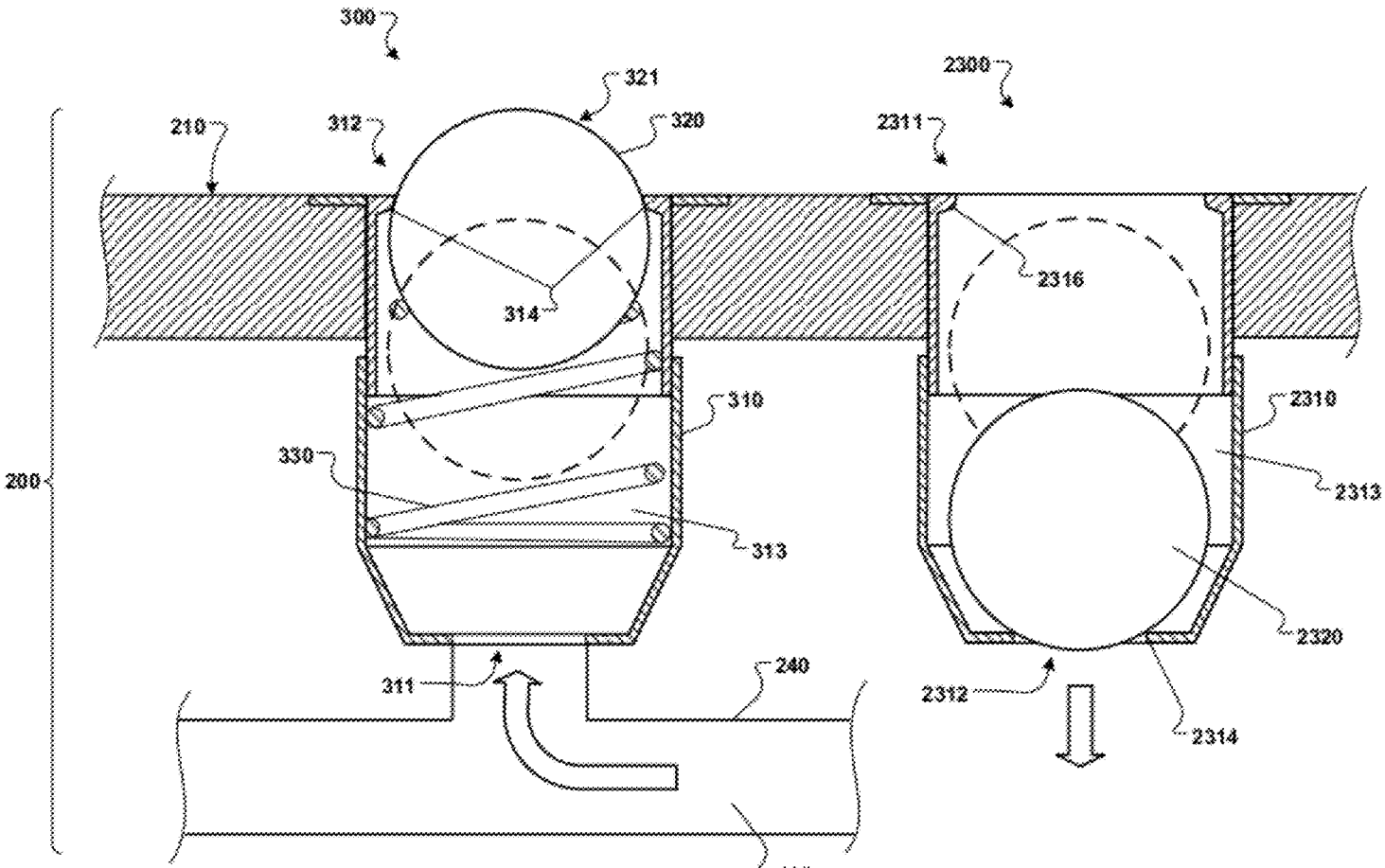
FIG. 9A is a sectional view of a travel surface of an amusement ride system having a mounted supply valve and a mounted drain valve.

Referring to FIGS. 8 and 9A, the drain valve 2300 includes a drain valve body 2310 defining at least one inlet port 2311 in fluid communication with the travel surface 210, an exit port 2312, and an interior water flow passageway 2313 between the inlet port(s) 2311 and the exit port 2312. The water flow passageway 2313 defines a drain valve seat 2314 near the exit port 2312. A drain valve element 2320 is disposed within the water flow passageway 2313 for movement among a first position in sealing engagement with the drain valve seat 2314 and a second position spaced from the drain valve seat 2314, permitting a flow of water through the water flow passageway 2313 defined by the drain valve body 2310, and out the exit port 2312. The exit port 2312 may drain to the ground or be in fluid communication with a drainage system that may deliver the water to a recirculation system (e.g. storage tank and pump) for reuse. The inlet port 2311 may define a valve element retaining feature 2316 to prevent escapement of the drain valve element 2320 from the drain valve body 2310. In the example shown in FIG. 8, the drain valve body 2310 defines the inlet port 2311 narrower than the water flow passageway 2313 retaining the drain valve element 2320. When the valve element 1320 is moved to the second position, allowing pressurized water flow out of the exit port 1312 of the valve 1300, some of the water 400 flows into the inlet port 2311 of the drain valve 2300 to escape the pressure of the vehicle 100 over head. The pressurized flow of water into the water flow passageway 2313 causes the drain valve element 2320 to move into sealing engagement with the drain valve seat 2314, closing the drain valve 2300. After the vehicle 100 passes away from the valve 1300, the water 400 becomes depressurized. In some implementations, the drain valve element 2320 is buoyant and moves between the first and second positions by buoyancy. The buoyant drain valve element 2320 floats up away from the drain valve seat 2314, opening the drain valve 2300 and allowing water 400 to drain off the travel surface 210. In additional implementations, the drain valve element 2320 is biased (e.g., via a spring) toward the second position and water pressure from the cushion of water under a vehicle passing there over causes the drain valve element 2320 to move to the first position in sealing engagement with the valve seat and once the pressure dissipates, the biased drain valve element 2320 moves to the second position to allow fluid flow therethrough. In the example shown in FIG. 9, the drain valve 2300 is substantially the same size as the supply valve 300. Different size drain valves 2300 may be used to regulate the escapement of water from the travel surface 210 in various regions of the support layer 205. In some examples, the drain valve 2300 is identical to the supply valve (e.g., for manufacturing purposes) and functions as a drain by not being connected to a water supply line 240.

Referring to FIGS. 10A-10B, in some implementations, the amusement ride system 10 includes supply valve 1300, which includes a valve body 1310 defining at least one inlet port 1311, an exit port 1312, and an interior water flow passageway 1313 between the inlet port(s) 1311 and the exit port 1312. The water flow passageway 1313 defines a valve seat 1314 near the exit port 1312. A valve element 1320 is disposed within the water flow passageway 1313 for movement among a first position in sealing engagement with the valve seat 1314 and a second position spaced from the valve seat 1314, permitting pressurized flow of water through the water flow passageway 1313 defined by the valve body 1310, and onto the travel surface 210. A valve element operator 1321 (in one example, a portion of the valve element 1320 protruding above the travel surface 210) extends through the exit port 1311 and beyond the valve body 1310 for actuating engagement by passing vehicles 100. The valve element 1320 may be spherical, elliptical, cylindrical, cubical, pyramidal, or any other suitable shape. In some examples, water is permitted to flow through one or more passageways defined through the valve element 1320 while the valve element 1320 is in the second position. As with supply valve 300, the valve element 1320 of supply valve 1300 may be urged toward its first position in engagement with the valve seat 1314 by water pressure in the water flow passageway 1313. Alternatively, the valve 1300 may include a spring 330 biasing the valve element 1320 into sealing engagement with the valve seat 1314, causing the valve 1300 to remain closed while not actuated. A combination of water pressure and biasing element may also be employed.

The valve 1300 may be releasably received by a valve receiver 1360, which is mounted via threads 1362 either into a threaded mounting hole defined by the support layer 205 or through a mounting hole defined by the support layer 205 and secured by a nut 1363. The valve receiver 1360 may define threads to receive the valve 1300 or slots to receive pegs protruding from the valve body 1310. In some examples, the valve 300, 1300 includes a sensor (e.g. proximity, infrared, acoustical, contact) that detects vehicles 100 passing over the valve 300, 1300 and triggers actuation of the valve element 320, 1320 to allow water 400 to pass through the valve 300, 1300. In implementations including a surface treatment 211, the surface treatment 211 is applied (e.g., toweled) level with the valve bodies 310 received in the support layer 205 or support layer sections 205A.

In some implementations, the interior water flow passageway 1313 is angled with respect to the travel surface 210 to provide a directed flow of water out of the valve 1300. The directed flow of water may be used to urge vehicles 100 passing over the valve in a particular direction of travel.

FIG. 10C illustrates an example of the valve 1300 including a misting valve element 1320A that defines multiple water channels 1324 extending therethrough. While seated in sealing engagement against the valve seat 1314, the misting valve element 1322 allows water to pass through the second port 1312 via the water channels 1324 to spray jets of water or mist in the air for riders to drive through and/or onto the travel surface 210 to keep the travel surface 210 damp and/or cool. The valve 1300 is shown inserted through a two-part support layer 205 having a first support component layer 220 that defines the travel surface 210 supported by a second support component layer 230. The first support component layer 220 may include a composite material, honeycomb structure, laminate, or other suitable material or structure. The second support component layer 230 may include a scaffolding component or a flooring structure.

Figure 3:
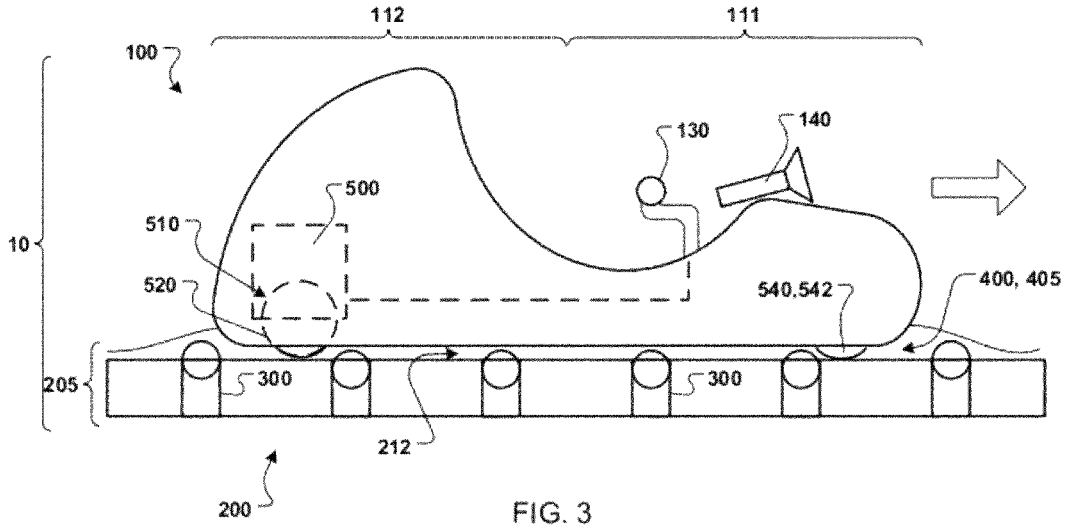
FIGS. 3-4 are side views of an amusement ride system having vehicles with a drive assembly.
Figure 4:
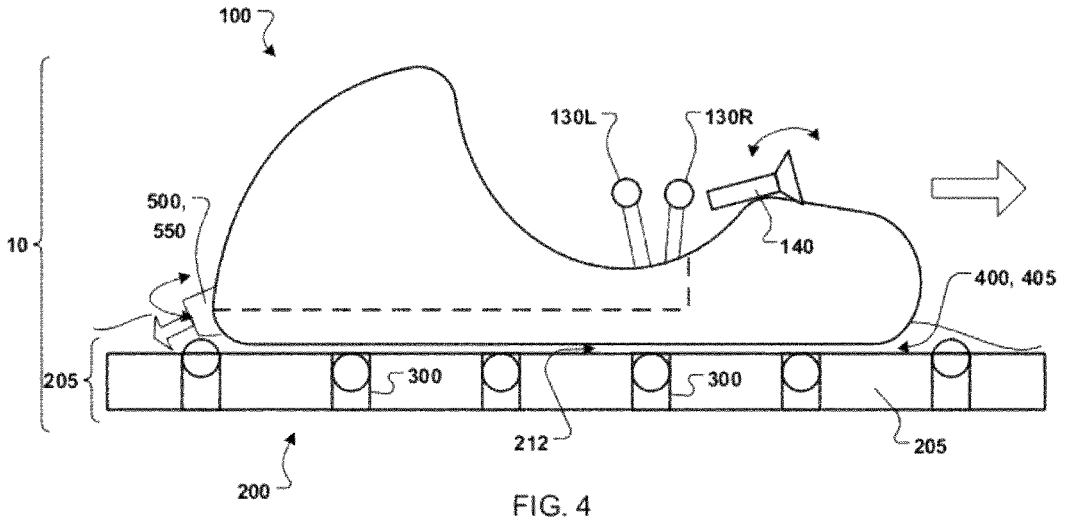
Figure 9B:
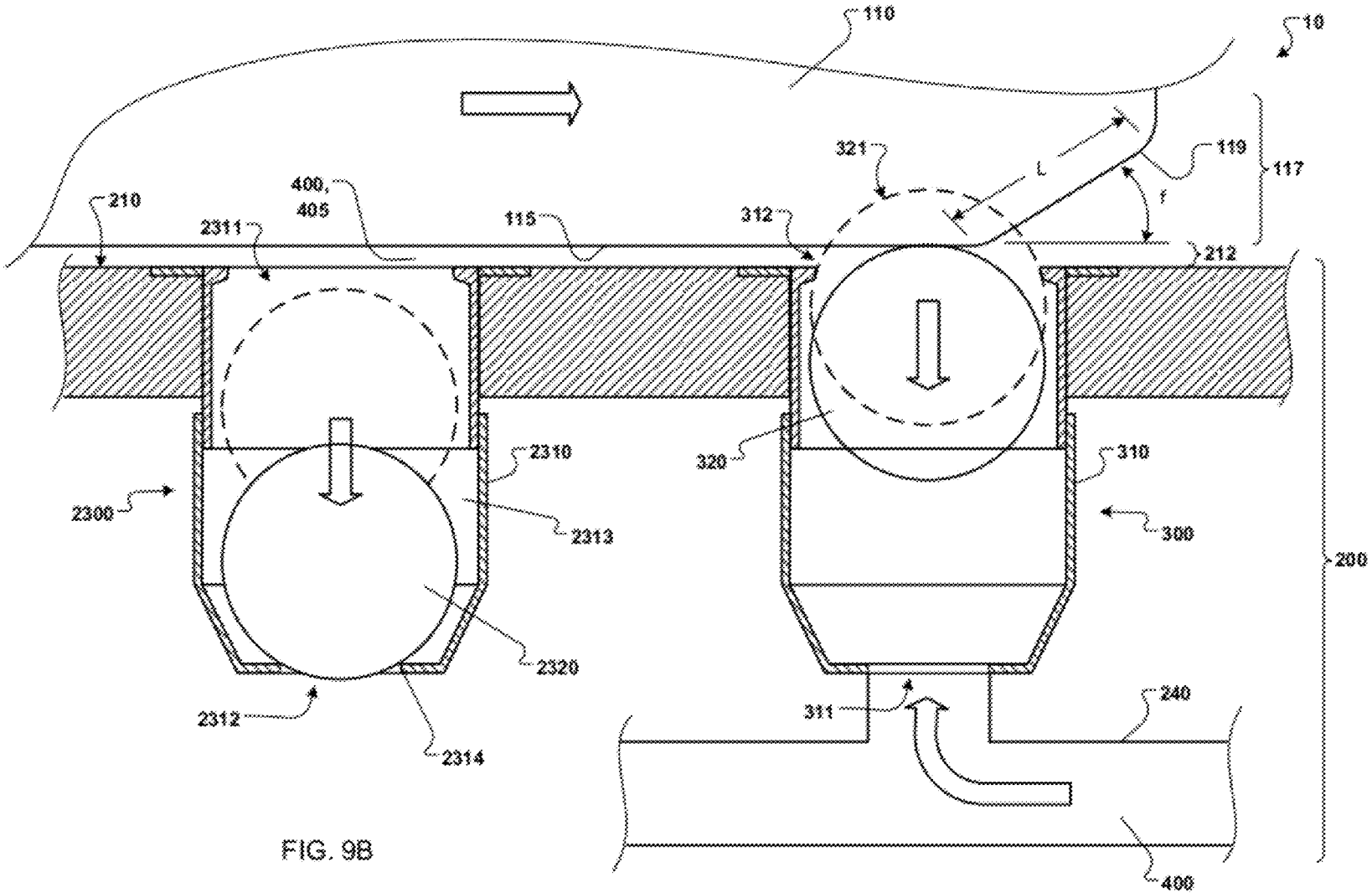
FIG. 9B is a sectional view of a vehicle travelling over a travel surface of an amusement ride system and engaging a supply valve.

Referring to FIGS. 3, 4, and 9B, the undersurface 115 of the vehicle body 110 engages the valve element operator 321 (e.g., exposed upper surface 321) of valve element 320 of each valve 300 passing beneath the vehicle body 110, thereby opening the valves 300 as each valve is engaged, and allowing fluid 400 to flow through the valves 300 to deliver a pressurized flow of water 400 into a confined region 212 defined between the vehicle undersurface 115 and the travel surface 210. The pressurized flow of water 400 into and through the confined region 212 creates a cushioning fluid layer 405 of water 400 to separate the vehicle undersurface 115 from the travel surface 210. As the vehicle 100 moves over the travel surface 210, the undersurface 115 of the vehicle body 110 remains in engagement with valve element operators for valves 300 beneath the vehicle body 110, and then releases the valve elements 320 of those valves 300 no longer beneath the vehicle body 110 to reestablish sealing engagement with the valve seat 314. In this manner, the cushioning fluid layer 405 is maintained substantially in the region of the vehicle undersurface, i.e. beneath the vehicle body 110. The fluid layer 405 supports the vehicle 100 and allows the vehicle 100 to move generally along the travel surface 210, by sliding, gliding and/or hydroplaning upon the travel surface 210. In some implementations, the valves 300 are arranged in the travel surface 210 so that the water cushion 405 supporting the vehicle 100 is being created and replenished by at least about three valves 300 at any given time.

When the supply valves 300, 1300 are actuated by a passing vehicle 100, pressurized water is permitted to flow through the water flow passageway 313 defined by the valve body 310 and onto the travel surface 210 into a region defined between the travel surface 210 and the undersurface 115 of a passing vehicle 100. As the vehicle 100 buoyantly floats on the cushion 405 of water 400, the hydrostatic pressure of the vehicle 100 on the cushion 405 of water 400 causes the valve element 2320 of the drain valve 2300 to move to the first position in sealing engagement with the valve seat 2314, thereby preventing drainage of the water 400 through the drain valve 2300. After the vehicle 100 passes over and away from the drain valve 2300, the hydrostatic pressure in the cushion 405 of water 400 dissipates (e.g., decreases to substantially zero or minimal pressure) and the valve element 2320 floats up to the second position away from the valve seat 2314, allowing the water 400 to flow through the water flow passageway 2313 and drain off the travel surface 210.

In some implementations, as illustrated in FIG. 9B, an edge portion 117 of the undersurface 115 of the vehicle body 110 (e.g., perimeter edge or general point of first contact with the of the valve element operator 321) engages the valve element operator 321 (e.g., exposed upper surface 321) of valve element 320 of each valve 300 passing beneath the vehicle body 110, thereby opening the valves 300 as each valve is engaged, and allowing fluid 400 to flow through the valves 300 to create the cushioning fluid layer 405 beneath the vehicle body 110. The undersurface edge portion 117 may be chamfered (e.g. sloped) or define a radius to aid movement of the vehicle over the encountered valve elements 320. In the example shown, the undersurface edge portion 117 is chamfered or has an edge surface 119 arranged at an angle $\phi$ with the undersurface 115 of between about 10° and about 60°, preferably about 30°. The angled or chamfered undersurface edge portion 117 guides the encountered valve elements 320 under the vehicle without shearing them off or otherwise damaging the valve elements 320. The angle $\phi$ and a length L of the edge surface 119 may be chosen to accommodate the sizes of the valves 300 used in the amusement ride system 10, so that the valve elements 320 are not damaged by the vehicles 100 passing over. The edge surface 119 is configured to engage the valve element operator 321 of an encountered valve element 320 and gradually push the valve element 320 downward below the vehicle undersurface 115, thereby actuating the valve 300 to release a pressurized flow of water 400 unto the travel surface 210.

Figure 11:
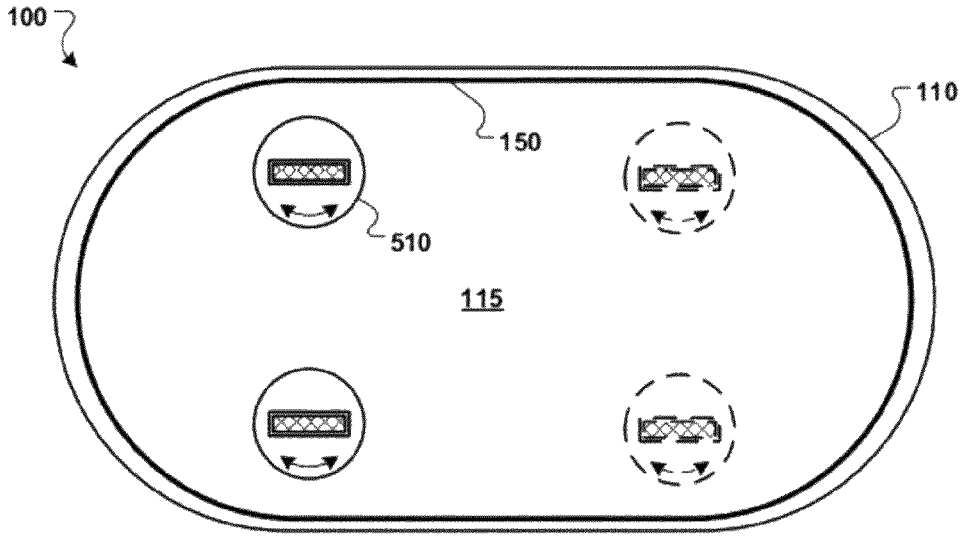
FIGS. 11-12 are bottom views of vehicles having one or more compliant flaps along a perimeter of a vehicle undersurface and a drive assembly.
Figure 12:
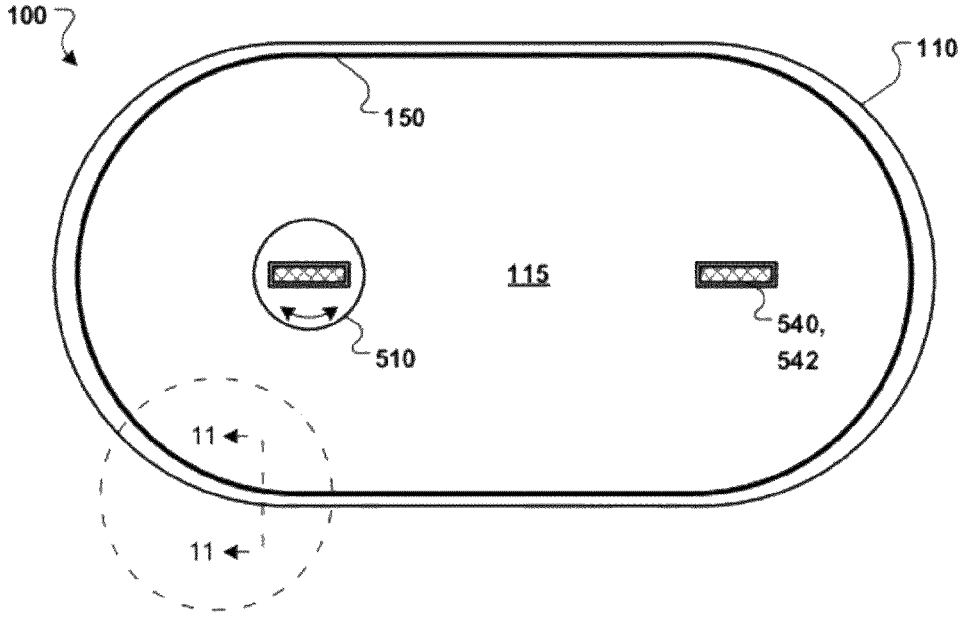
Figure 13:
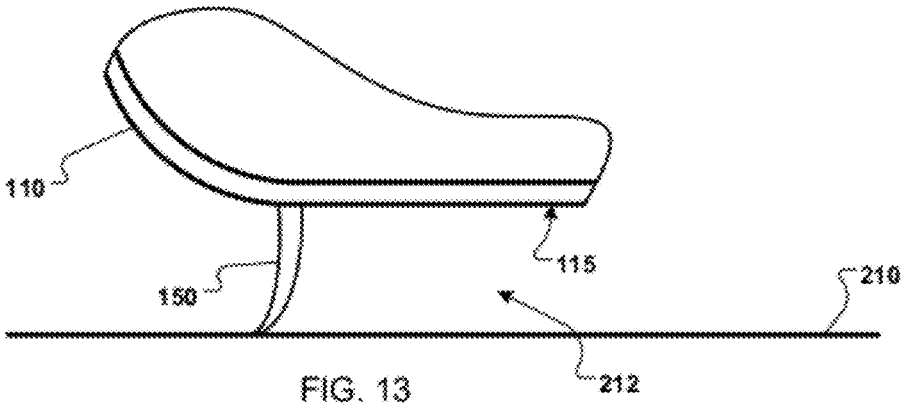
FIG. 13 is a partial sectional view of a vehicle undersurface shown in FIG. 12.

In the examples illustrated in FIGS. 11-13, the water cushion is confined to the region generally between the vehicle undersurface 115 and the travel surface 210 by a compliant flap 150 (e.g. rubber squeegee) extending generally downwardly from the vehicle body 110 and circumscribing about or along the perimeter of the vehicle undersurface 115. The compliant flap 150 resists fluid flow from beneath the vehicle body 110, and in cooperation with the vehicle undersurface 115 of the vehicle body 110 and the travel surface 210 of the support layer 205, defines the confined region or gap 212 between the undersurface 115 of the vehicle body 110 and the travel surface 210 of the support layer 205 containing the cushion 405 of fluid 400. The compliant flap 150 serves to augment creation of the cushion 405 of fluid 400 (e.g. water) separating the vehicle undersurface 115 from the travel surface 210. In some examples, the compliant flap 150 circumscribes the confined region 212 defined between the vehicle undersurface 115 and the travel surface 110 into which the pressurized flow of water 400 is delivered by actuated valves 300.

Referring back to the examples illustrated in FIGS. 1-4, a steering device 130, disposed in the passenger compartment 120, is operably coupled to or in communication with a drive system 500 that propels and/or directs the vehicle 100 over the travel surface 210. In the example shown in FIG. 3, the steering device 130 is a joystick-type device, where a user pushes the stick 130 in a direction of desired travel to maneuver the vehicle 100 in that direction In the example shown in FIG. 4, the steering device is a pair of right and left joystick-type devices 130R, 130L, where a user pushes both sticks 130R, 130L forward or backward to drive the vehicle 100 forward or backward, respectively. The user pushes the right stick 130R forward and pulls the left stick 130L back to drive the vehicle in a left direction with respect to the user, and pushes the left stick 130L forward and pulls the right stick 130R back to drive the vehicle in a right direction with respect to the user. The right and left joystick-type devices 130R, 130L may be angled slightly outward to ergonomically accommodate relatively taller or larger users. The drive system 500 may include a driven wheel 520 disposed in engagement with the travel surface 210, e.g. as shown in FIG. 3, or a fluid jet 550 having a fluid discharge direction controllable by the steering device 130, as shown in FIG. 4.

In some implementations, the drive system 500 includes one or more drive assemblies 510 housed by the vehicle body 110, e.g. as shown in FIGS. 11-12, and configured to maneuver the vehicle 100 over the travel surface 210. Referring to FIGS. 14A-22, each drive assembly 510 includes a drive wheel 520 operably coupled to a motor 530 and in contact with the travel surface 210 of the support layer 205 to move the vehicle 100 in a desired direction. In the examples shown in FIGS. 14A-14C, the vehicle 100 has substantially circular vehicle body 110 from a top view and includes right and left drive assemblies 510R, 510L disposed on corresponding sides of a passenger compartment 120 along a transverse center axis 103 defined by the vehicle body 110. The right and left drive assemblies 510R, 510L are operably connected to or otherwise in communication (e.g., electrically or mechanically) with corresponding right and left joystick-type devices 130R, 130L for controlling operation of the respective drive assemblies 510R, 510L. In this example, the wheels 230 of the right and left drive assemblies 510R, 510L are aligned with a longitudinal axis 105 defined by the vehicle body 110, and are driven in forward or reverse directions to cause forward, backward rightward, and leftward movement of the vehicle 100. In some examples, the right and left drive assemblies 510R, 510L are differentially driven for maneuvering the vehicle 100. In particular examples, to turn left, the left drive assembly 510L is either held stationary, set in neutral, or driven backwards, while the right drive assembly 510R is driven forward. Similarly, to turn right, the right drive assembly 510R is either held stationary, set in neutral, or driven backwards, while the left drive assembly 510L is driven forward. With both drive assemblies 510R, 510L in the neutral position, the vehicle 100 is allowed to float freely over the travel surface 210.

A user 50 received in the passenger compartment 120 is generally situated between the right and left drive assemblies 510R, 510L with a center of gravity CG of the user 50 substantially near or over the vertical center C of the vehicle 100. In some implementations, a back support portion 162 of a seat 160 in the passenger compartment is angled forward from vertical by angle β of between about 5° and about 40°, preferably 10°, causing the user 50 to lean forward, thereby shifting the center of gravity CG of the user 50 substantially near or over the vertical center C of the vehicle 100 and/or shifting the user's center of gravity CG substantially in line with a vertical center axis 107 defined by the vehicle 100. Moving the user's center of gravity CG over the center C of the vehicle 100 allows the weight of the user 50 to be distributed evenly across the undersurface 115 of the vehicle 100, as well as between the right and left drive assemblies 510R, 510L. If a user's center of gravity CG is located too far away from the center C of the vehicle 100, the vehicle may become lopsided and no longer rest evenly on the cushion of water 405, which may result in an edge 117 of the vehicle body 110 contacting or scratching the travel surface 210. The angled back support portion 162 causes the user 50 to lean forward in an aggressive position to engage the right and left joystick-type devices 130R, 130L and operate the vehicle 100.

Figure 14A:
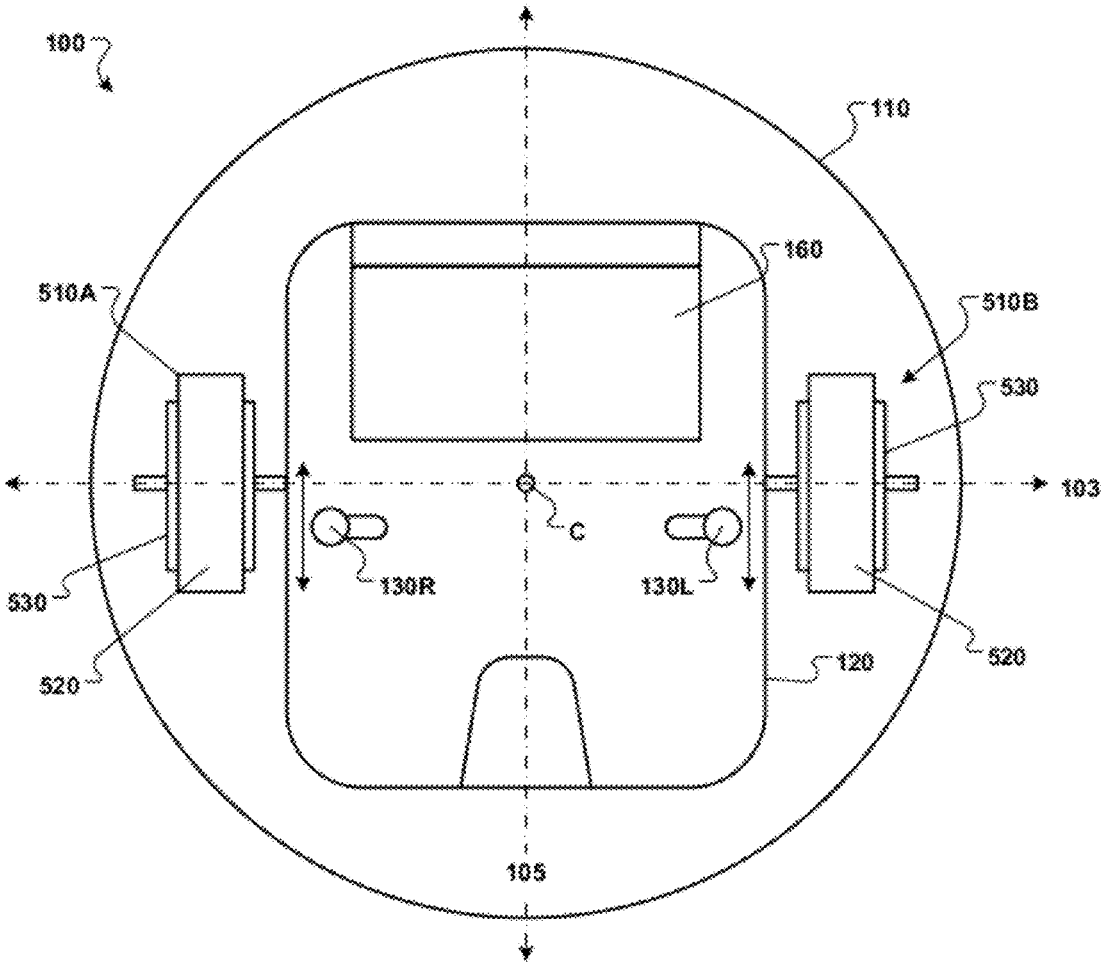
FIG. 14A is a top view of a vehicle having right and left drive assemblies.
Figure 14B:
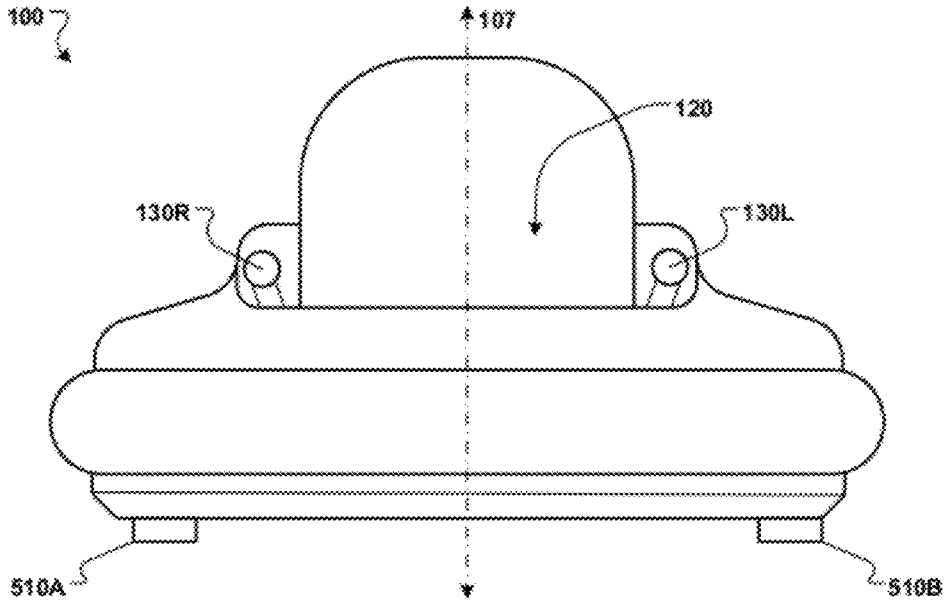
FIG. 14B is a front view of a vehicle having right and left drive assemblies.
Figure 14C:
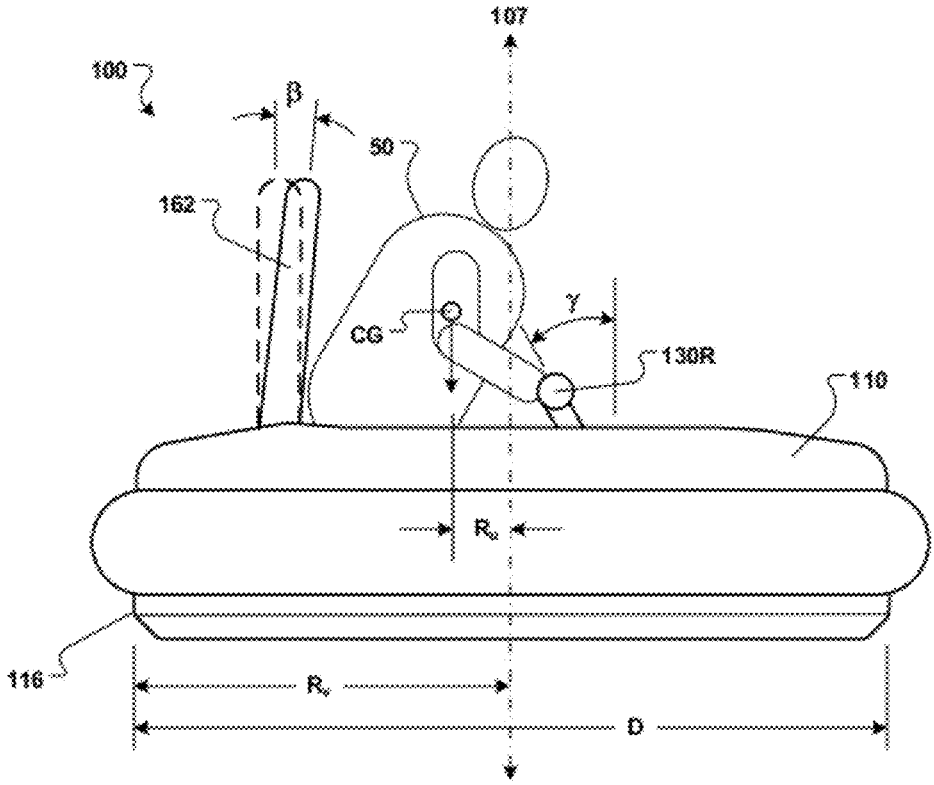
FIG. 14C is a side view of a vehicle having right and left drive assemblies.

Referring to FIG. 14C, in some implementations, the right and left joystick-type devices 130R, 130L are arranged to cause a user 50 to lean forward while operating the vehicle 100, thereby shifting the user's center of gravity CG over or toward the center C of the vehicle 100. In some examples, the vehicle body 110 has a diameter D (or length from front to back, if non-circular) of between about 40 inches (102 cm) and about 60 inches (152 cm), preferably about 43 inches (109 cm). The right and left joystick-type devices 130R, 130L are located between about 12 inches (30 cm) and about 30 inches (76 cm), preferably about 25 inches (63 cm), from the back support portion 162 of the seat 160. This location of joystick-type devices 130R, 130L causes a user 50 to lean forward to operate the vehicle 100. The joystick-type devices 130R, 130L may be angled rearward (e.g., placed at angle γ from vertical of between about 10° and about 45°, preferably about)30° while in their neutral position, thereby causing the user to lean further forward while pushing the joystick-type devices 130R, 130L forward to drive the vehicle 100 forward. Therefore, the vehicle 100 may be configured to substantially maintain the user's center of gravity CG within a radius $R_u$ from the vehicle's center C, where $R_u$ is less than about 75%, preferably less than about 40%, of a distance $R_v$ from the center C of the vehicle 100 to rear edge 116 of the vehicle body 110.

Figure 14D:
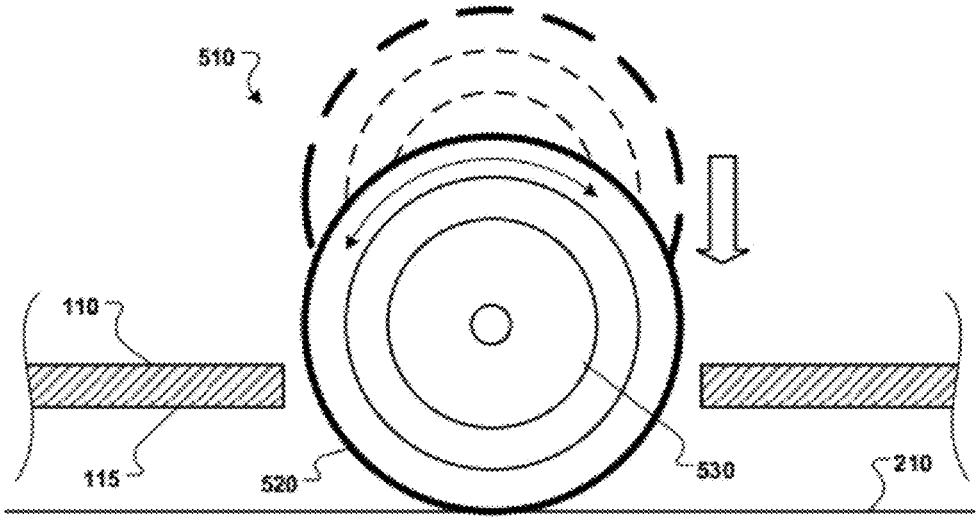
FIG. 14D is a sectional view of a vehicle with a drive assembly that moves between first and second positions during operation.
Figure 14E:
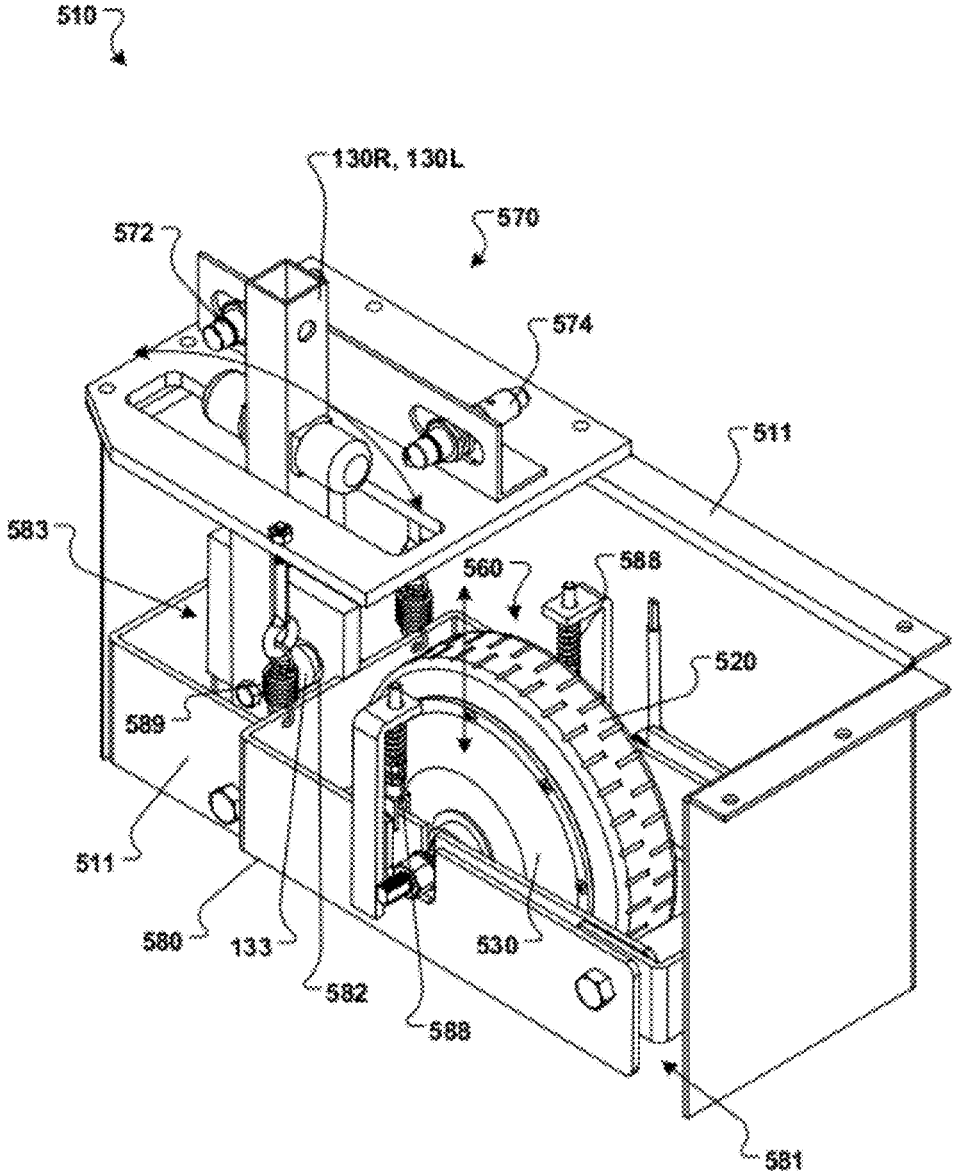
FIG. 14E is a perspective view of a drive assembly for a vehicle.
Figure 14F:
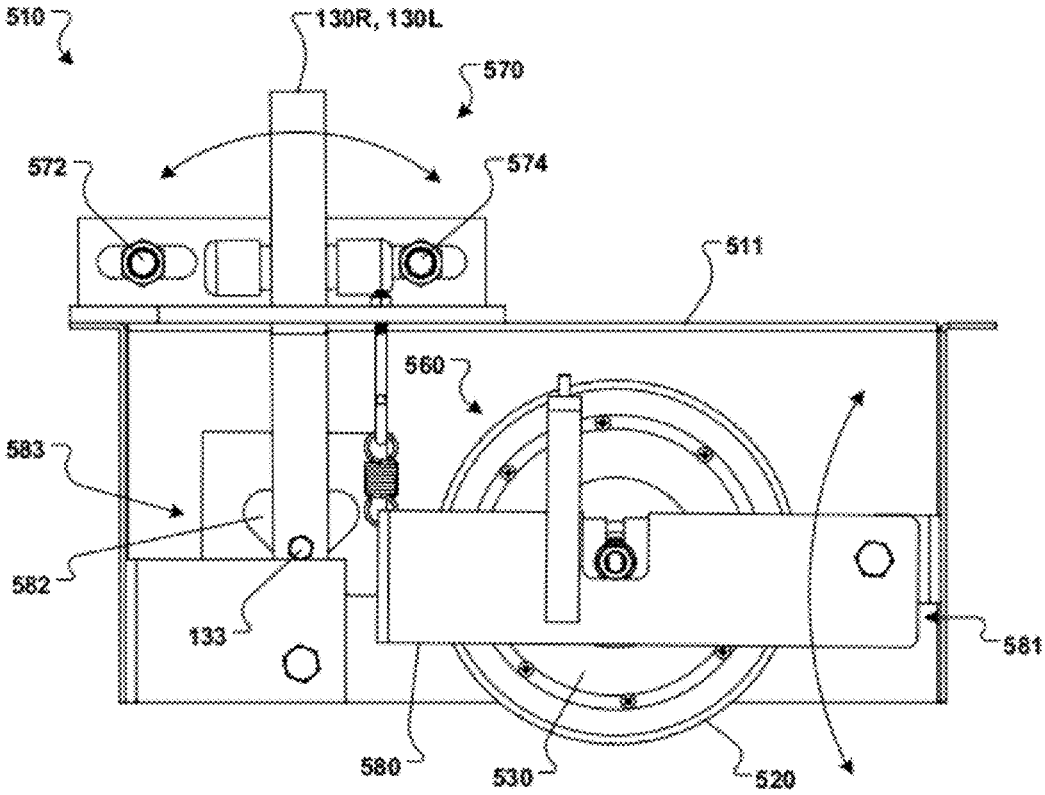
FIG. 14F is a side view of the drive assembly of FIG. 14E.
Figure 14G:
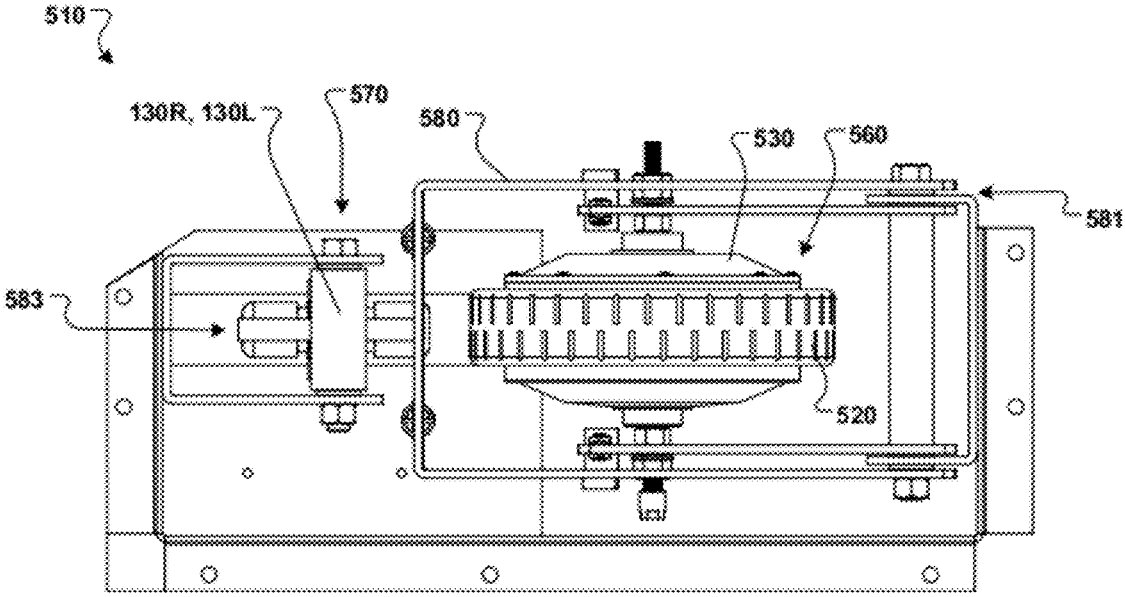
FIG. 14G is a bottom view of the drive assembly of FIG. 14E.
Figure 14H:
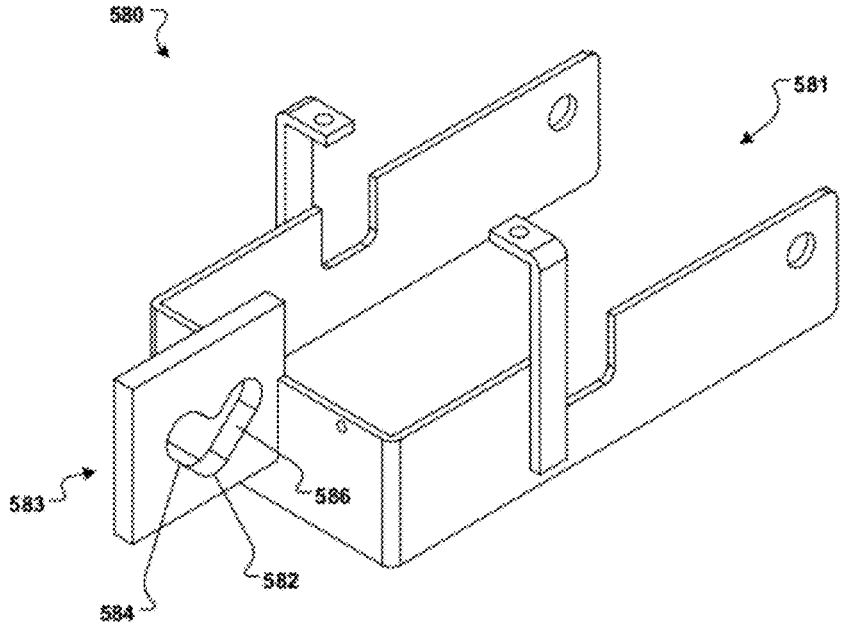
FIG. 14H is a perspective view of a pivot link for a drive assembly.
Figure 14I:
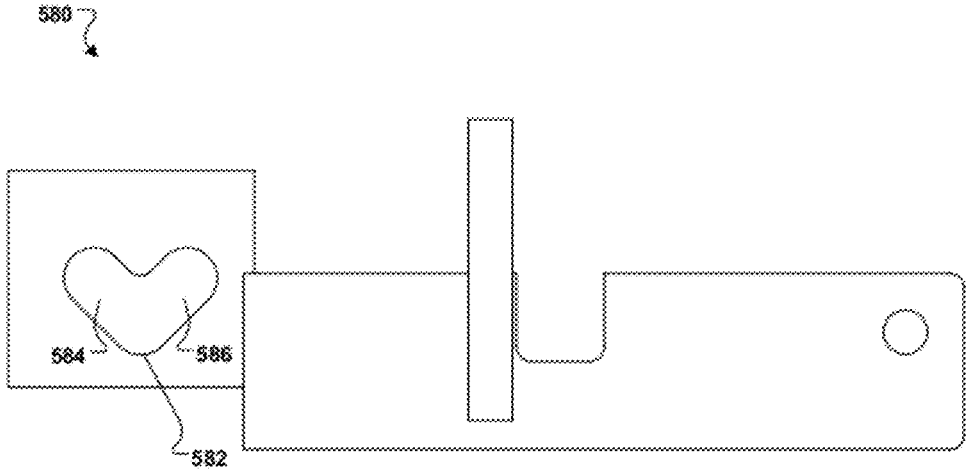
FIG. 14I is a side view of the pivot link of FIG. 14H.

Referring to FIG. 14D, in some implementations, each drive assembly 510 disposed on the vehicle body 110 includes a wheel 520 (e.g., solid rubber or air filled) concentrically mounted about a motor 530 (e.g., high efficiency disc DC brush motor), such that the wheel 520 rotates about the motor 530, thereby providing a compact configuration for the drive assembly 510. In some examples, an XTi Hub Motor, available from Assembled Products Corporation, 115 E. Linden, Rogers, Ark. 72756, USA, may be used for the drive assembly 510. When the joystick-type device 130R, 130L is in a neutral position, the corresponding drive assembly 510R, 510L is in a first position disengaged from the travel surface 210 and/or retracted into the vehicle body 110. When the joystick-type device 130R, 130L is moved to a forward or backward position, the corresponding drive assembly 510R, 510L is moved to a second position in engagement with the travel surface 210 (e.g., moved downward and exposed below the undersurface 115 of the vehicle body 110 to contact the travel surface 210) and driven in a corresponding forward or backward direction. The speed at which the drive assembly 510R, 510L is driven corresponds to the relative position of the forward or backward position of the joystick-type device 130R, 130L relative to the neutral position (e.g., the further away from the neutral position corresponds to greater acceleration and/or speed (i.e. gradient speed control)). In some examples, movement of the joystick-type device 130R, 130L to a forward or reverse position away from the neutral position corresponds to a respective forward or reverse "on" position (e.g., one speed). In some examples, as the joystick-type device 130R, 130L is moved between a forward position and a backward position, the corresponding drive assembly 510R, 510L moves (e.g. via a cam assembly, 4-bar linkage, or a one or two axis actuation stage) from the second position in engagement with the travel surface 210 and driven in the forward direction to the first position disengaged from the travel surface 210 (e.g., with the motor 230 disengaged from the wheel 220 (neutral) or the wheel 220 stopped, as by a brake) and back to the second position in engagement with the travel surface 210 with the wheel 220 being driven in the backward direction. Actuation or movement of the drive assembly 510R, 510L between the first and second positions can be provided by a mechanical linkage, which is a series of rigid links connected with joints to form a closed chain, or a series of closed chains. Each link has two or more joints, and the joints have various degrees of freedom to allow motion between the links. The mechanical linkage may be configured to take an input from the associated joystick-type device 130R, 130L and produce an output of altering the motion, velocity, acceleration, and applying mechanical advantage to moving the drive assembly 510R, 510L between the first and second positions. In some examples, a four-bar linkage is used to move the drive assembly 510R, 510L between the first and second positions. In some examples, the first position of the drive assembly 510R, 510L is a neutral position, and the drive assembly 510R, 510L is movable to two different second positions (e.g., a forward drive position and reverse drive position). Therefore, as a user move the joystick-type device 130R, 130L from a forward position to a backward position, the drive assembly 510R, 510L moves from a forward drive second position with the wheel being driven in a forward direction to a neutral, first position with the wheel being non-driven, to a reverse drive second position with the wheel being driven in a reverse direction.

Referring to FIG. 14E-14I, in some implementations, each drive assembly 510 includes a drive assembly housing 511 to which is mounted a wheel assembly 560 and an actuation assembly 570. Right and left drive assemblies 510R, 510L provide a differential steering capabilities of the vehicle 100. The wheel assembly 560 is disposed on the vehicle body 110 includes the wheel 520 (e.g., solid rubber or air filled) concentrically mounted about the motor 530 (e.g., high efficiency disc DC brush motor), such that the wheel 520 rotates about the motor 530. The actuation assembly 570 includes the joystick-type device 130R, 130L, which has an engagement feature 133 (e.g., protrusion, pivot, etc.) configured to be received by a substantially "V" shaped joystick receiver 582 (e.g., slot, groove, aperture, channel, etc.) defined by a pivot link 580 having first and second ends 581, 583. In some examples, the joystick receiver 582 defines a substantially "U" shape. The first pivot link end 581 is pivotally connected to the drive assembly housing 511 or the vehicle body 110, while the receiver is defined substantially near the second pivot link end 583. The wheel assembly 560 is disposed on the pivot link 580 substantially near the first pivot link end 581. The joystick-type device 130R, 130L rests at or is spring biased toward a neutral position (e.g., substantially vertical) with the engagement feature 133 at or near the bottom of the substantially "V" shaped joystick receiver 582. As a user moves the joystick-type device 130R, 130L to a forward position, the engagement feature 133 moves up a first leg 584 of the joystick receiver 582 (FIGS. 14H and 14I), thus causing the pivot link 580 to rotate or pivot downwardly, which in turn moves the wheel assembly 560 into contact with the travel surface 210. Drive spring(s) 588 may be attached to the pivot link 580 to bias the pivot link 580 downward, such that the drive spring(s) 588 provide a biasing force to hold the wheel 520 in contact with the travel surface 210 when the drive assembly is an forward or reverse driving state. Likewise, neutral spring(s) 589 may be attached to the pivot link 580 to bias the pivot link 580 upward, such that the neutral spring(s) 589 provide a biasing force to move the pivot link 580 to a neutral position, with the drive assembly 560 in a neutral state (e.g., with the joystick-type device 130R, 130L in a neutral position (e.g., vertical)). At the forward position, the joystick-type device 130R, 130L actuates or triggers a forward sensor 572 (e.g., inductive switch, position sensor, optical sensor, etc.) in electrical communication with the wheel assembly 560. In response to a signal from the forward sensor 572, the wheel assembly 560 drives in a forward direction. Similarly, as a user moves the joystick-type device 130R, 130L to a rearward position, the engagement feature 133 moves up a second leg 586 of the joystick receiver 582 (FIGS. 14H and 14I), thus causing the pivot link 580 to rotate or pivot downwardly, which in turn moves the wheel assembly 560 into contact with the travel surface 210. At the rearward position, the joystick-type device 130R, 130L actuates or triggers a rearward sensor 574 (e.g., inductive switch, position sensor, optical sensor, etc.) in electrical communication with the wheel assembly 560. In response to a signal from the rearward sensor 574, the wheel assembly 560 drives in a reverse direction. In some implementations, the forward and rearward sensors 572, 574 provide variable position signals corresponding to a position of the joystick-type device 130R, 130L. The wheel assembly 560 can drive in the forward and rearward directions at variable speeds, in response to the respective signals of the forward and rearward sensors 572, 574.

Figure 15A:
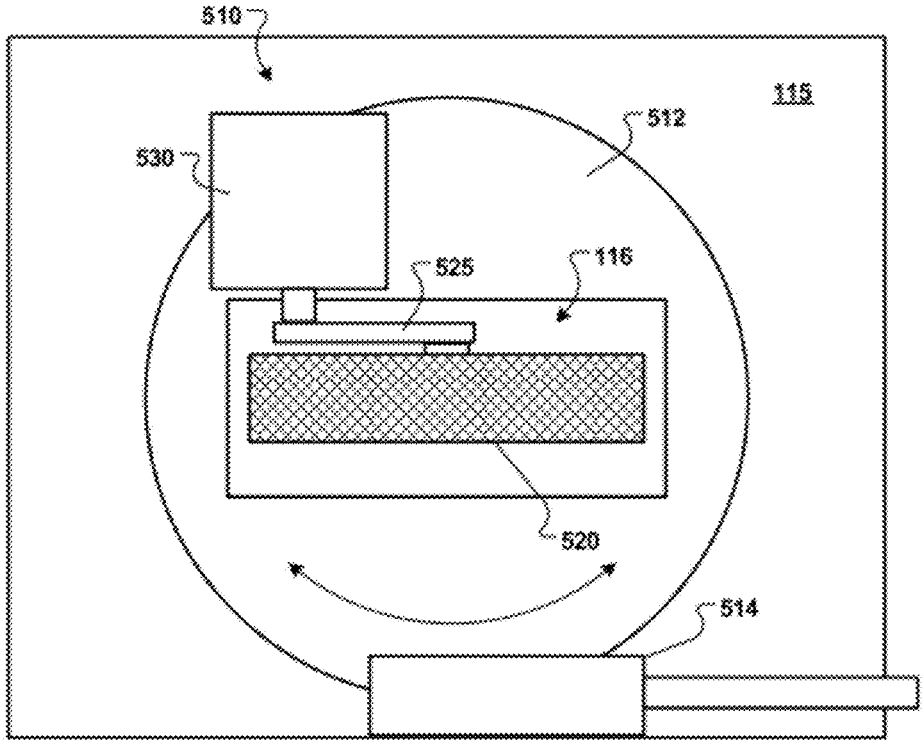
FIG. 15A is a sectional view of a drive assembly for a vehicle having a drive wheel that swivels and moves vertically.

Referring to FIG. 15A, in some implementations, the drive assembly 510 may be secured to a circular swivel plate 512 that freely rotates or pivots in a corresponding mounting plate opening 116 defined in the undersurface 115 of the vehicle body 110, and may be used to allow the drive wheel 520 to caster over the travel surface 210. In some implementations, a swivel actuator 514 (e.g. a motor, linkage, or rack and pinion system) is coupled to the swivel plate 512 to control rotation of the swivel plate 512, thereby controlling a drive direction.

In the examples illustrated in FIGS. 3 and 12, the vehicle 100 includes a drive wheel 520 and a tag wheel 540. The wheel drive wheel 520 and the tag wheel 540 are disposed on opposite portions 111, 112 of the vehicle 100, so that the driven vehicle 100 does not spin uncontrollably in place. The tag wheel 540 may be implemented as a steering wheel 542 that is controlled by the steering device 130.

Figure 17:
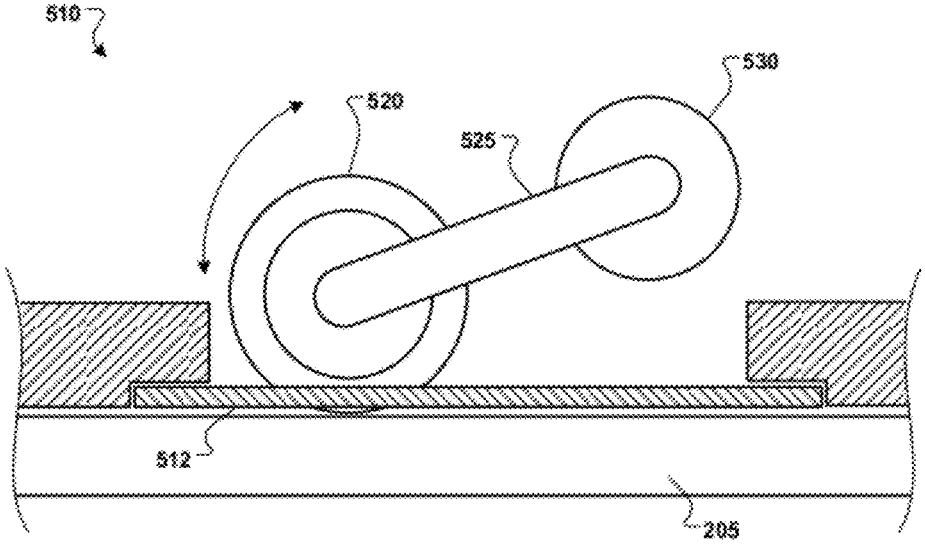

In the example illustrated in FIGS. 15A-17, the swivel plate 512 is constrained in the mounting plate opening 116 from moving upwardly in the vertical direction. The motor 530 is mounted to the swivel plate 512 and drives the drive wheel 520, which is coupled to a linkage 525 that allows the drive wheel 520 to pivot upwardly into the vehicle body 110, as, for example, when the supply of fluid 400 to the travel surface 210 ceases and the vehicle 100 rests on the travel surface 210 of the support layer 205, as shown in FIG. 17. Referring once again to FIGS. 5-7, when the supply of fluid 400 to the travel surface 210 is resumed, the undersurface 115 of the vehicle body 110 engages the valve element operators 321 of valve elements 320 for valves 300 beneath the vehicle body 110, displacing the valves element 320 from sealing engagement with the associated valve seats 314, allowing water 400 to flow through the opened valves 300, creating the cushioning fluid layer 405 which elevates the vehicle body 110 upon the travel surface 210. As the vehicle body 110 elevates, the linkage 525 pivots with the drive wheel 520 downwardly to maintain contact between the drive wheel 520 and the travel surface 210 of the support layer 205. In the example shown in FIG. 16, a spring 526 biases the linkage 525 and associated drive wheel 520 downwardly to maintain contact with the travel surface 210 of the support layer 205.

Figure 18:
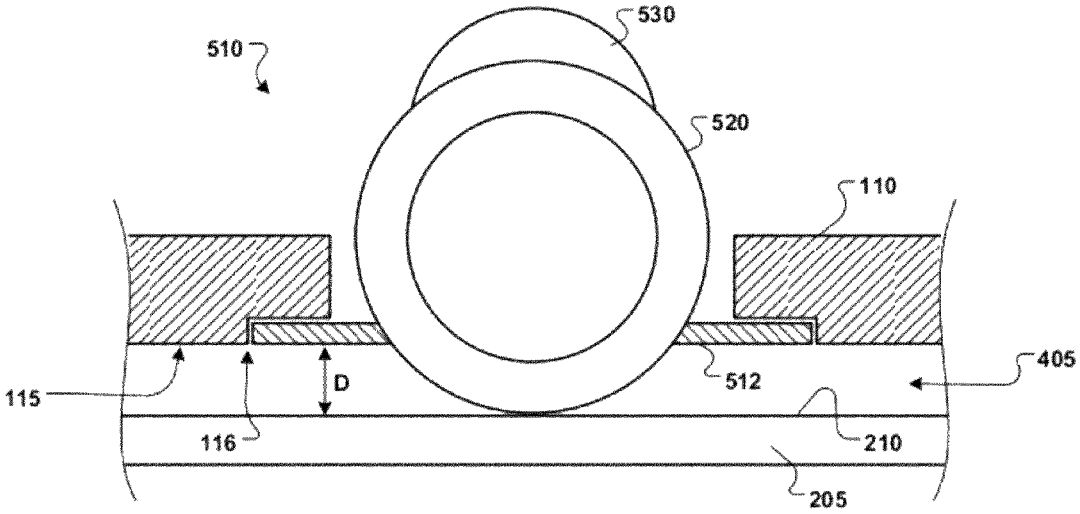
FIG. 18 is a side view of a drive assembly for a vehicle having a drive wheel that swivels.

In the example illustrated in FIG. 18, the swivel plate 512 is constrained in the mounting plate opening 116 from moving upwardly in the vertical direction and the drive wheel 520, which is coupled to the motor 530, does not pivot upwardly into the vehicle body 110. Instead, this configuration maintains a minimum distance, D, between the undersurface 115 of the vehicle body 110 and the travel surface 210 of the support layer 205. Consequently, in the absence of the fluid layer 405, the vehicle 100 can still be moved via the wheel(s) 520 over the travel surface 210.

Figure 15B:
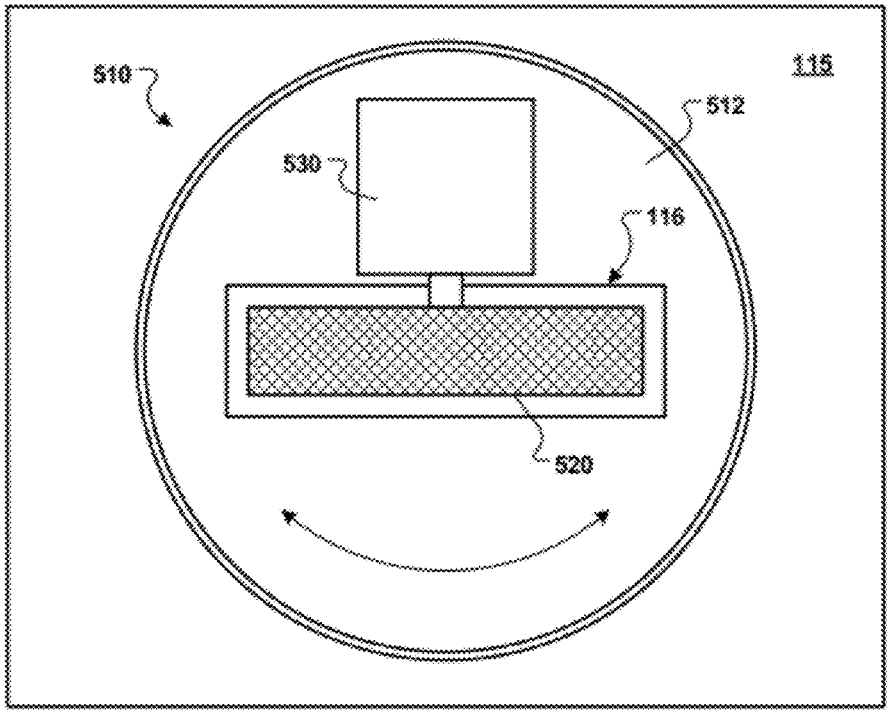
FIG. 15B is a top view of a drive assembly for a vehicle having a drive wheel that swivels.
Figure 16:
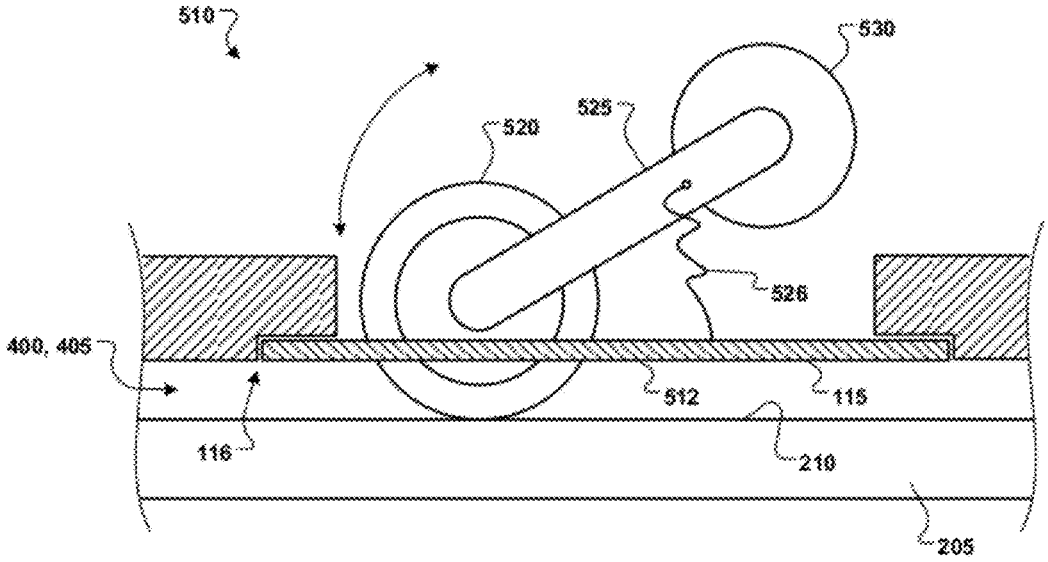
FIGS. 16-17 are side views of a drive assembly for a vehicle having a drive wheel that swivels and moves vertically.
Figure 19:
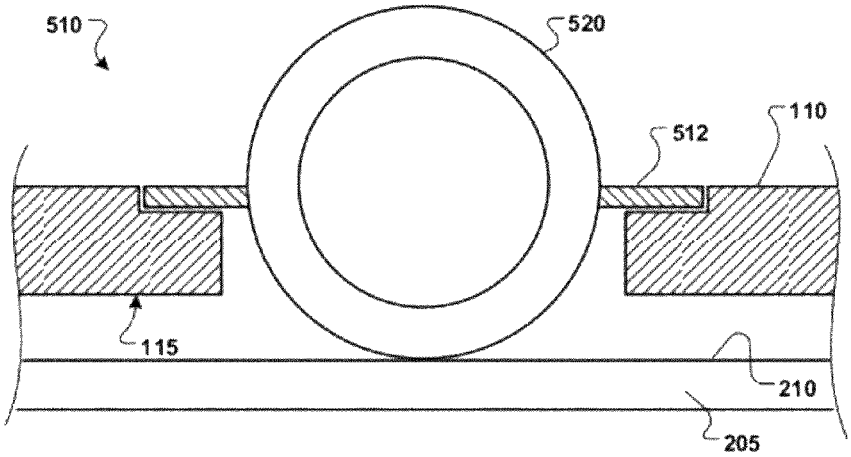
FIGS. 19-20 are side views of a drive assembly for a vehicle having a drive wheel that swivels and moves vertically.
Figure 20:
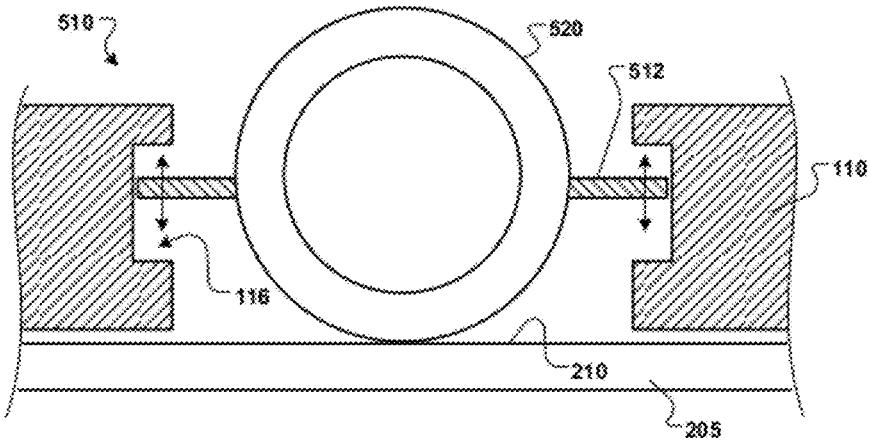

In the example illustrated in FIGS. 15B, 19, and 20, the swivel plate 512 and associated drive assembly 510 are free to move upwardly in the vertical direction. In some examples, the swivel plate 512 exits the mounting plate opening 116, as shown, while in other examples, the mounting plate opening 116 is defined sufficiently deep to accommodate the elevation change between the swivel plate 512 and the vehicle body 110. As in the previous example, the motor 530 is secured to the swivel plate 512 and is also coupled to the drive wheel 520. When the supply of fluid 400 to the support surface 205 ceases, the drive assembly 510 maintains its position with the drive wheel 520 in contact with the travel surface 210 as the vehicle body 110 descends onto and rests on the travel surface 210 of the support layer 205. When the supply of fluid 400 to the travel surface 205 is resumed, the undersurface 115 of the vehicle body 110 engages the valve element operators of valve elements 320 for valves 300 beneath the vehicle body 110, displacing the valves element 320 from sealing engagement with the associated valve seats 314, allowing water 400 to flow through the opened valves 300, creating the cushioning fluid layer 405 which elevates the vehicle body 110 upon the travel surface 210. As the vehicle body 110 elevates, the drive assembly 510 maintains its position with the drive wheel 520 in contact with the support surface 205.

Figure 21:
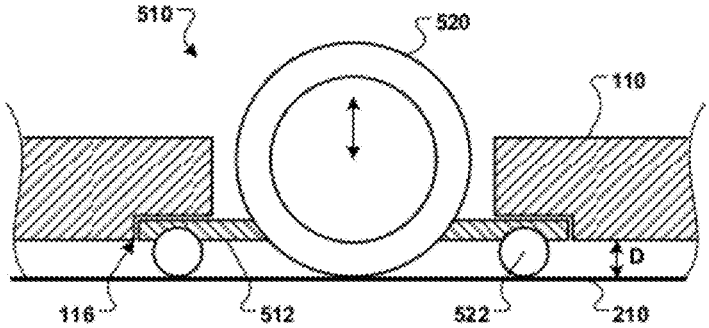
FIG. 21 is a side view of a drive assembly for a vehicle having a drive wheel that swivels and moves vertically.
Figure 22:
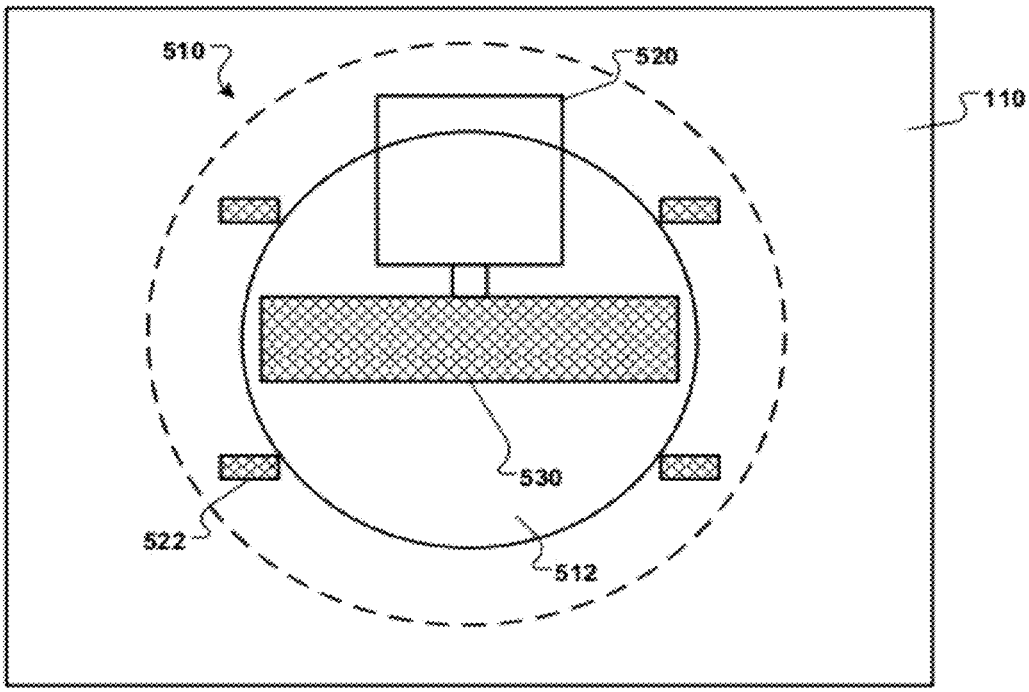
FIG. 22 is a top view of the drive assembly shown in FIG. 21.

In the example illustrated in FIGS. 21-22, the swivel plate 512 is constrained in the mounting plate opening 116 from moving upwardly in the vertical direction. The motor 530 is coupled to the drive wheel 520 and move together vertically in relation to the swivel plate 512 (e.g. via a linkage, bracket, guide, etc.). One or more support wheels 522 (four are shown) are mounted to the swivel plate 512 to maintain a minimum distance, D, between the undersurface 115 of the vehicle body 110 and the travel surface 210 of the support layer 205. The support wheels 522 may include caster wheels or roller balls in sockets that allow movement in any direction. Consequently, in the absence of the fluid layer 405, the vehicle 100 can be moved along the travel surface 210. The minimum distance D is set so that the undersurface 115 of the vehicle body 110 engages the valve element operators 321 of valves 300 beneath the vehicle body 110. When fluid 400 is supplied to the travel surface 210, it flows through the open valves 300 to create the cushioning fluid layer 405 which elevates the vehicle body 110 above the travel surface 210. As the vehicle body 110 elevates, the drive assembly 510 maintains its position with the drive wheel 520 in contact with the travel surface 210.

Figure 23:
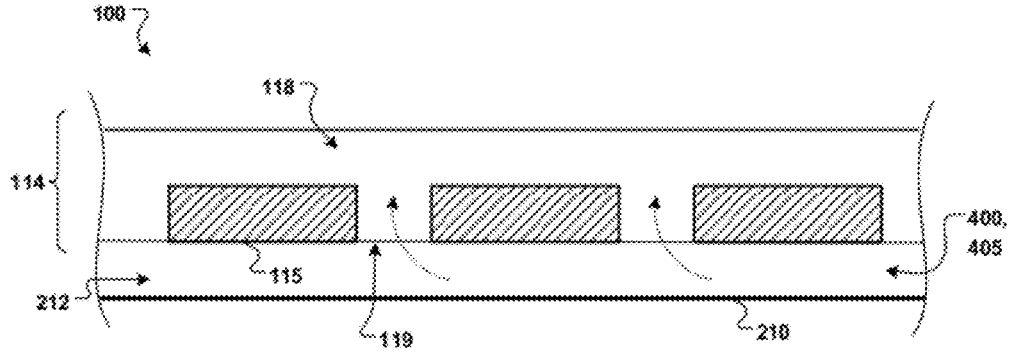
FIG. 23 is a side view of a lower portion of a vehicle defining a reservoir cavity.
Figure 24A:
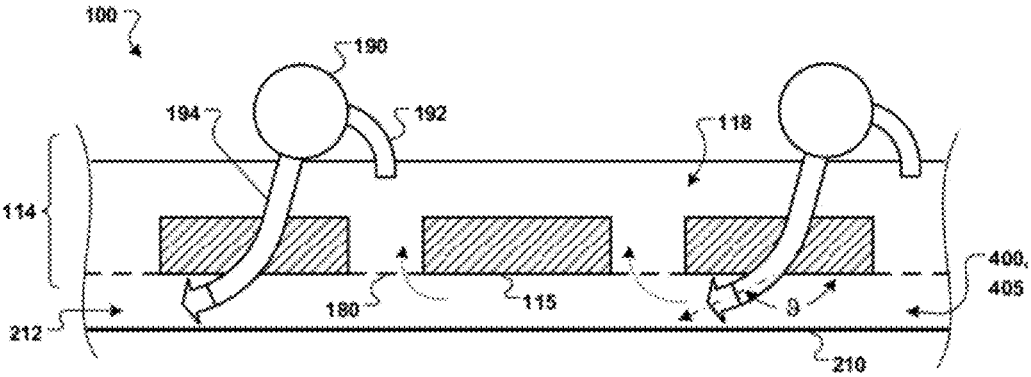
FIG. 24A-24B are side views of a lower portion of a vehicle defining a reservoir cavity and having a pump discharging below the vehicle.
Figure 24B:
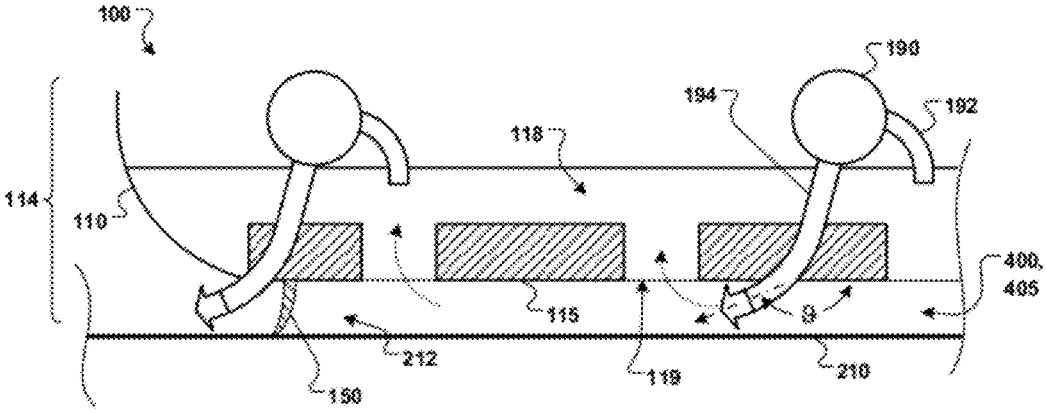

In the examples illustrated in FIGS. 23-24B, a lower portion 114 of the vehicle 100 defines a reservoir cavity 118 for receiving and temporarily holding fluid 400. The undersurface 115 of the vehicle 100 defines one or more apertures 119 in fluid communication with the reservoir cavity 118. As fluid 400 flow from the open valves 300 underneath the vehicle 100, the weight of the vehicle 100 creates hydrostatic pressure on the fluid 400 causing the fluid 400 to follow along paths of least resistance out from beneath the vehicle 100, with one being through the apertures 119 and into the reservoir cavity 118. Examples including the compliant flap 150 circumscribing the vehicle body 110 to define the region 212 between the undersurface 115 of the vehicle body 110 and the travel surface 210 of the support layer 205 experiencing relatively larger hydrostatic pressure on the fluid 400 in the region 212, thereby resulting in relatively greater fluid flow into the reservoir cavity 118. In some examples, e.g. as shown in FIG. 24A, a screen 180 (e.g. wire mesh, plate defining an array of holes, or a grill) is secured over the aperture 119 to prevent debris from entering the reservoir cavity 118.

In some implementations, at least one pump 190 having an intake line 192 and an outlet line 194 is disposed in the vehicle 100. The intake line 192 is in fluid communication with the reservoir cavity 118 and the outlet line 194 discharges fluid 400 into the region 212 beneath the vehicle 100, as shown in FIG. 24A, and/or behind the vehicle 100, as shown in FIG. 24B. The outlet line 194 discharges fluid 400 at an angle θ with respect to the undersurface 115 of the vehicle body 110, to propel the vehicle 100 forward generally along the travel surface 210. The pump 190 may function as part of the drive system 500 and/or fluid jet 550 described earlier in regards to FIG. 4. The steering device 130 may control the discharge direction and/or angle θ of the pump outlet line 194/fluid jet 550 to maneuver the vehicle 100 along the travel surface 210. In some examples, the travel surface 210 of the support layer 205 has a knurled, dimpled, or other surface finish that provides fictional resistance against the discharged fluid 400 to aid propulsion efficiency.

Figure 25:
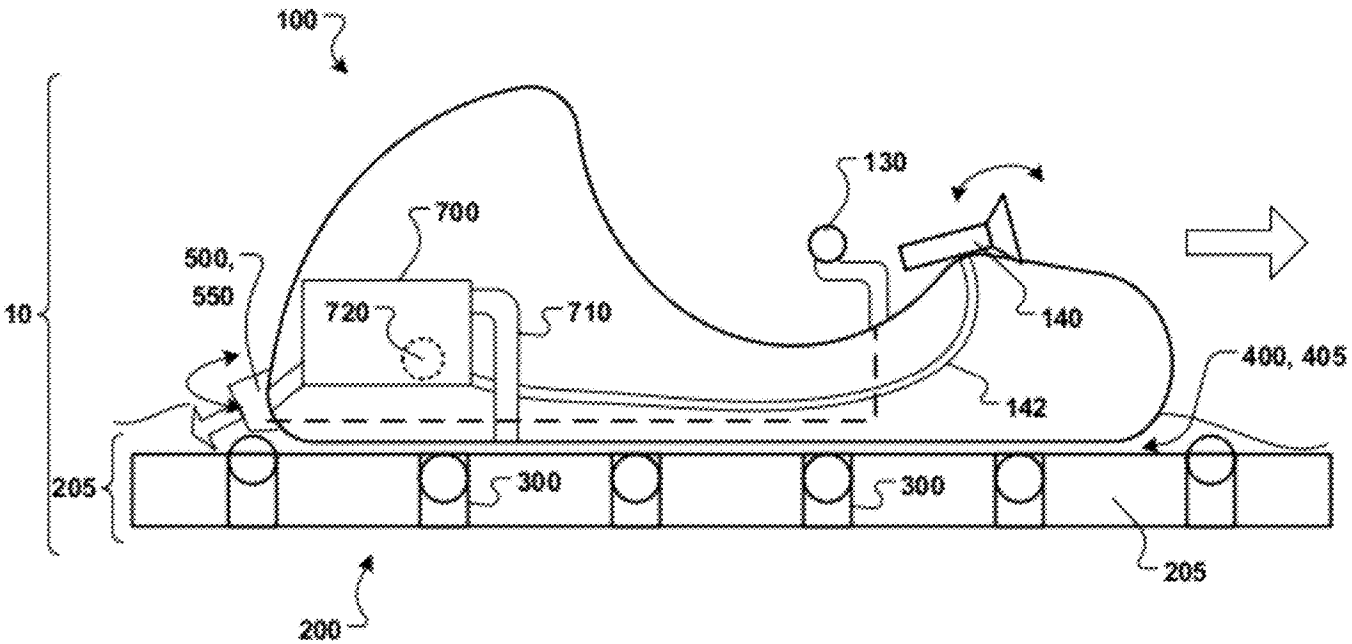
FIG. 25 is a side view of a lower portion of a vehicle defining a reservoir cavity and having a pump discharging behind the vehicle.

In the example illustrated in FIG. 25, the vehicle body 110 houses a reservoir 700 for receiving and temporarily holding fluid 400. One or more reservoir feed lines 710 extend from the reservoir 700 to the undersurface 115 of the vehicle body 110 to receive pressurized water 400, 405 trying to escape from under the vehicle 100. The received water 400 flows into the reservoir 700 for delivery to a water propulsion system 550 (e.g., pump, water jet, etc.) and/or a water gun 140.

In some examples, the vehicle 100 includes a water gun 140, as shown in FIGS. 1-4, mounted on the forward portion or bow 111 of the vehicle 100. The water gun 140 may be in fluid communication with the reservoir cavity 118 and/or the outlet line 194 of the pump 190 discharging fluid 400, as shown in FIGS. 24A and 24B. The water gun 140 is rotatable (e.g. via a ball and socket joint) in one or more directions to provide a sweeping range of movement for a user to shoot fluid 400 (e.g. water) throughout a defined range of motion. In some cases, the water gun 140 is tethered to the vehicle 100, as by a water supply line 142. In some examples, as shown in FIG. 25, a feed line 710 is in fluid communication with a pump 720 that draws water 400 from below the vehicle 100 and delivers a pressurized flow of water 400 to the water gun 140. The pump 720 may also be used to aid the water propulsion system 550 (e.g., which may have one or more motors or pumps) to boost propulsion of the vehicle 100. In some examples, at least one of the joystick-type devices 130 includes a button or trigger for actuating the water gun 140.

Figure 26:
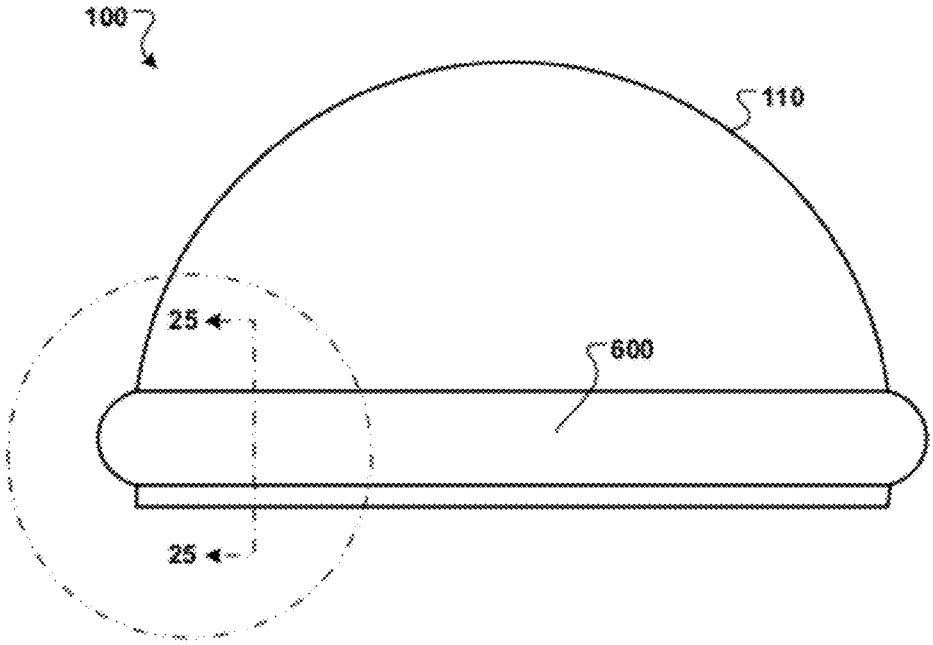
FIG. 26 is a back view of a vehicle with a bumper.
Figure 27:
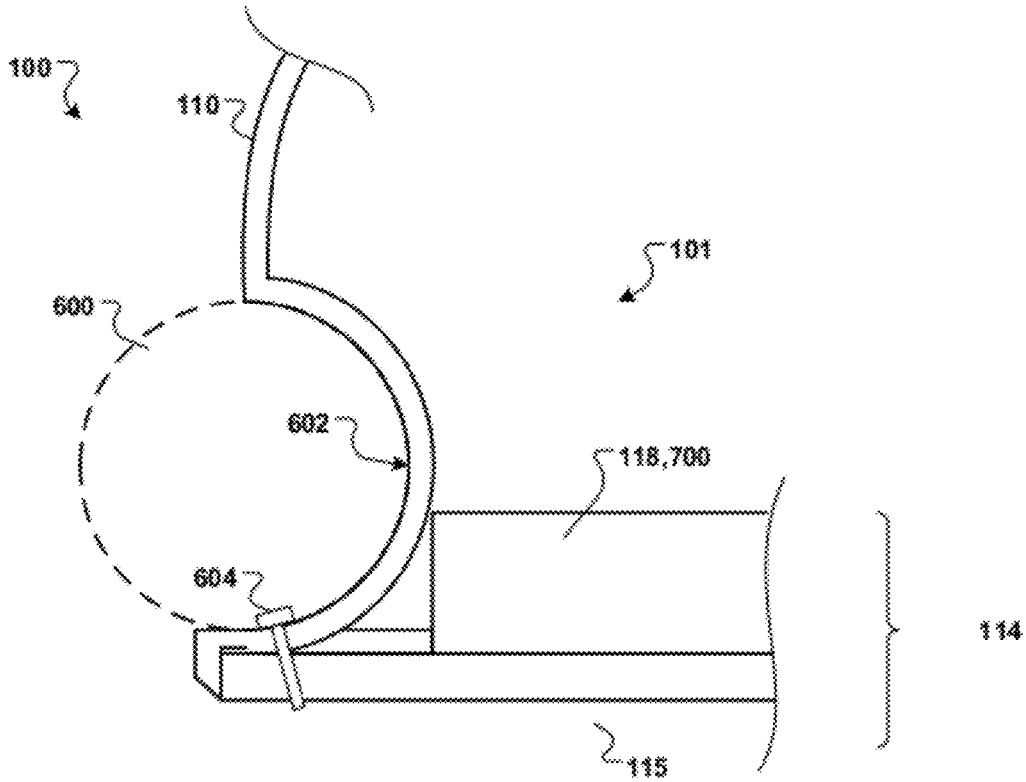
FIG. 27 is a partial sectional view of the vehicle shown in FIG. 26.

In the examples illustrated in FIGS. 26-27, the vehicle 100 includes a bumper 600 (e.g. solid rubber or inflatable tube) secured to the vehicle body 110. The vehicle body 110 may define a bumper recess 602 configured to receive the bumper 600. In some implementations, the vehicle body 110 is separate from and removably secured (e.g. via a fastener 604, such as bolt or eccentric clamp) to the lower portion 114 of the vehicle 100. This provides access to an inside portion 101 of the vehicle 100 (e.g. for maintenance) and allows different vehicle bodies 110 to be interchanged on the lower portion 114 of the vehicle 100 (e.g. for maintenance, appearance, etc). The different vehicle bodies 110 may have different, shapes, colors, themes, or other aesthetic characteristics.

Figure 28:
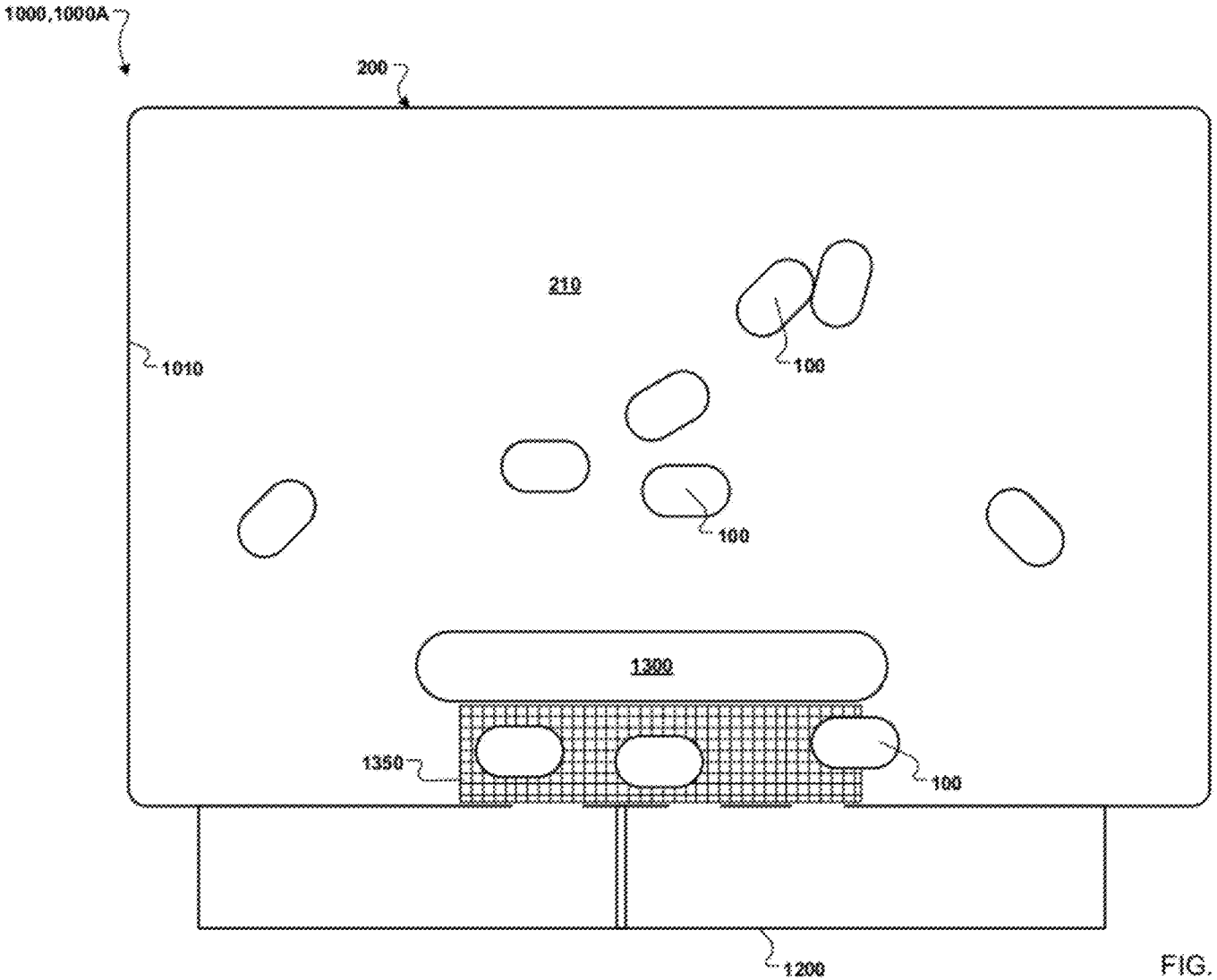
FIG. 28 is a top view of an amusement ride system with an infrastructure having a travel surface defining a rectangular track.
Figure 29:
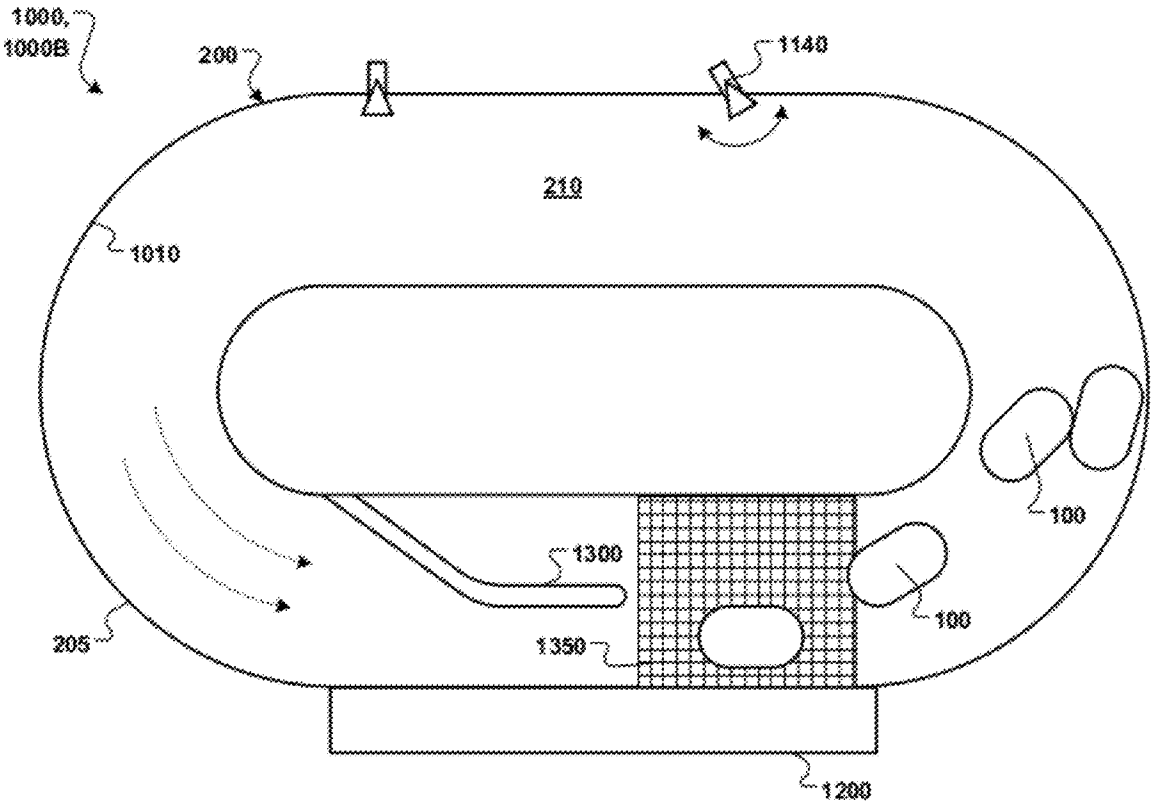
FIG. 29 is a top view of an amusement ride system with an infrastructure having a travel surface defining an oval track.
Figure 30:
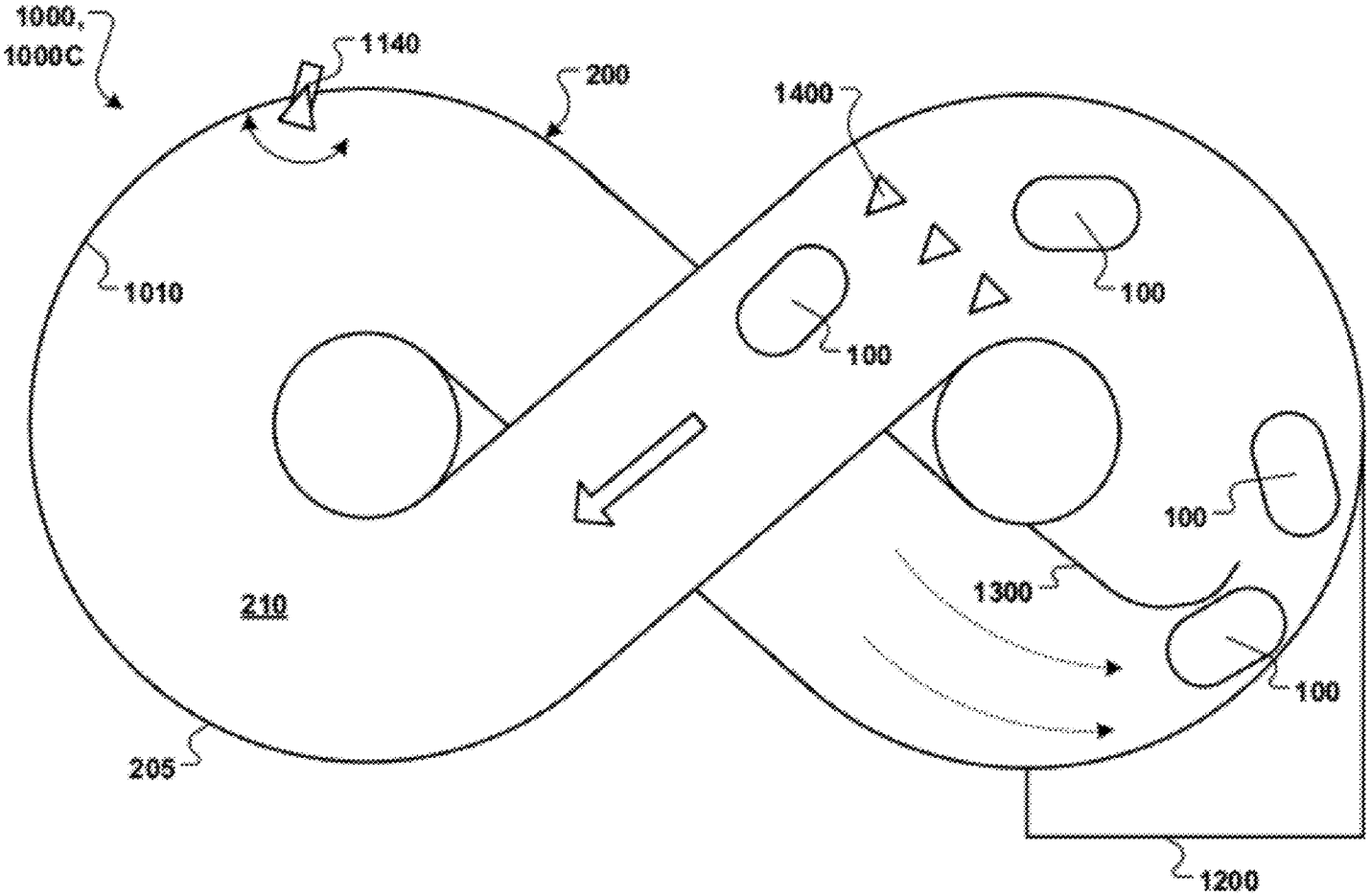
FIG. 30 is a top view of an amusement ride system with an infrastructure having a travel surface defining a figure-eight track.

Referring to FIGS. 28-30, an amusement ride infrastructure 1000 includes a track or way having a travel surface 210 defined by the support layer 205, as described above, supporting one or more vehicles 100, as described above. Examples of suitable tracks 1000 include, but are not limited to, a rectangular area 1000A, as shown in FIG. 28, a substantially oval track 1000B, as shown in FIG. 29, and a figure-eight track 1000C, as shown in FIG. 30. In one example, a 5000 square foot track 1000 accommodates between about 30-40 vehicles. The track 1000 may include walls 1010 to confine the vehicles 100 on the track 1000. The track 1000 may include a passenger loading/unloading area 1200, which provides an ingress and egress from the track 1000 as well as access to the vehicles 100 for passengers to get in/on and ride the vehicles 100 and depart from the vehicles 100.

In some examples, the track 1000 includes a course diverter 1300 which diverts a travel direction of the vehicles 100. The course diverter 1300 is typically a rail or wall used to divert the travel direction of the vehicles 100 toward the passenger loading/unloading area 1200. A conveyer belt 1350 may be used to carry vehicles 100 through the loading/unloading area 1200 for passenger loading and unloading. The conveyer belt 1350 may be a rubber belt or other non-skid/non-slippery material conducive for safely walking on. The conveyer belt 1350 can be used to pull and eject vehicles 100 from and onto the track 1000.

In some implementations, the track 1000 includes a vehicle advancer 1400 disposed on the track wall 1010 or travel surface 210, as shown in FIGS. 29-30. In some implementations, the vehicle advancer 1400 can be adjusted among various positions to influence a desired travel direction of the vehicle 100. The vehicle advancer 1400 may be a fluid jet discharging fluid 400 or a driven roller (e.g. rubber roller or wheel) configured to contact and engage (e.g. by friction) the undersurface 115 of a vehicle 100 that propels the vehicle 100. The vehicle advancer 1400 can be used to divert the travel direction of the vehicle 100 or propel the vehicle 100 up, down, or along the track 1000. In some examples, the vehicle advancer 1400 includes a bucket of water spilled on to the track 1000 to move vehicles 100 about the track 1000.

In some implementations, the track 1000 is configured as an obstacle course having multiple course diverters 1300 and vehicle advancers 1400 arranged to move or guide the vehicles 100 about the track 1000 (e.g. a large-scale pinball table). For example, a vehicle 100 may be guided down a path by a course diverter 1300 toward one or mere vehicle advancers 1400 that move the vehicle 100 in an unexpected direction toward another path.

Figure 31:
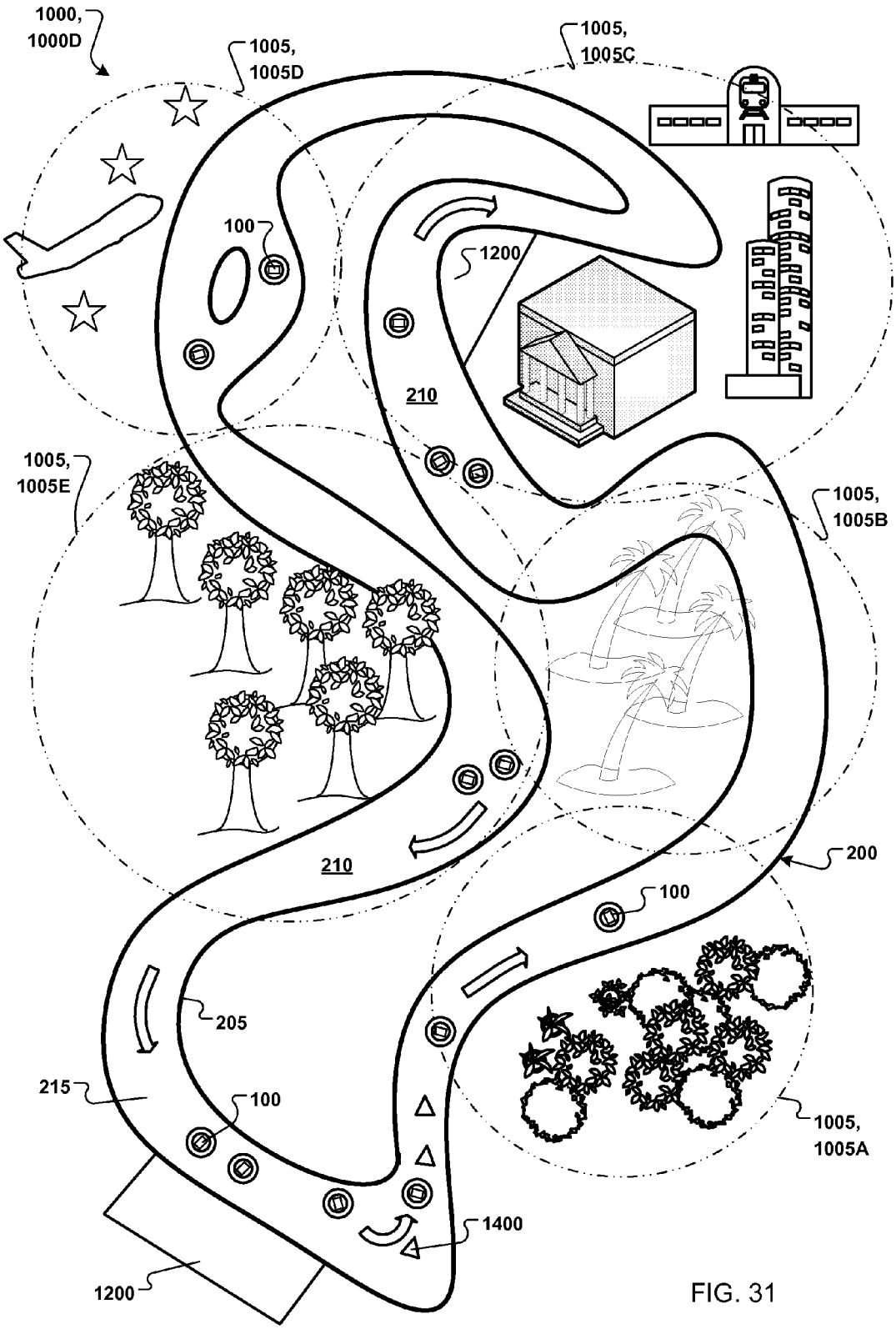
FIG. 31 is a top view of an amusement ride system with an infrastructure having a travel surface meandering through themed regions.

Referring to the example shown in FIG. 31, an amusement ride infrastructure 1000D includes a track or way 215 having a travel surface 210 defined by the support layer 205, supporting one or more vehicles 100. The track or way 215 may be closed looped as shown or open-ended as a means for conveying vehicle riders from one point to another. In the example shown, the amusement ride infrastructure 1000D provides one or more themed regions 1005 for experience by a vehicle rider progressing along the track 215. These themed regions 1005 may include a jungle themed region 1005A with animals and/or natives viewable or available for interaction by the vehicle rider; a tropical themed region 1005B, a city themed region 1005C (e.g., Paris, New York, Chicago, etc.) with objects (e.g., cars, buildings, etc) and/or people viewable or available for interaction by the vehicle rider; a space themed region 1005D; and/or a forest themed region 1005E. Other possible themed regions may include, but are not limited to, e.g., an underwater theme with tunnels, cartoon theme, region specific themes (e.g., U.S. Southwestern, etc.), and other imaginable themes for experience by riders. As the vehicle 100 progresses along the track 215, the vehicle 100 passes through each of the themed regions 1005. In some examples, the vehicle may be able to stop at a passenger loading/unloading area 1200 within each themed region 1005 to experience that themed region 1005.

Figure 32:
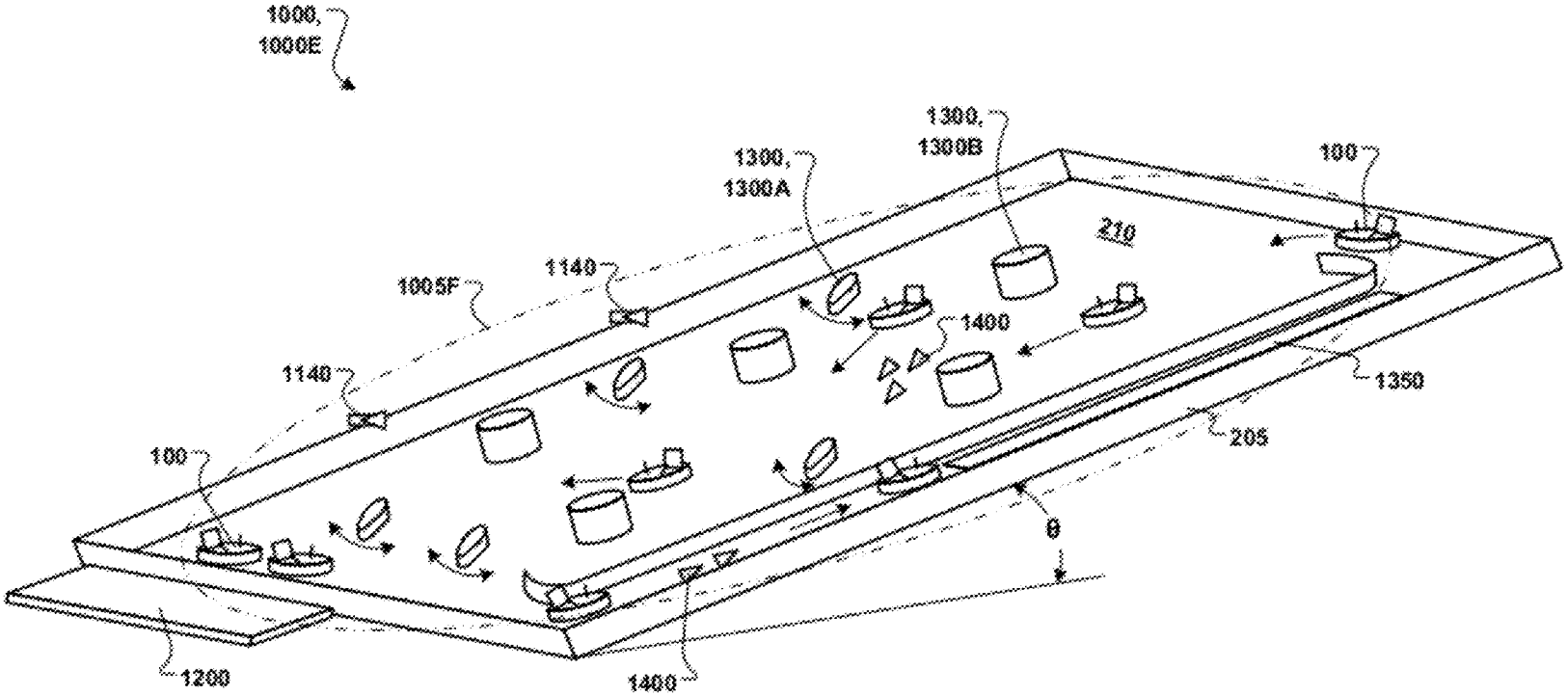
FIG. 32 is a top view of an amusement ride system with an infrastructure having an inclined travel surface, with a pinball themed region.

In the example shown in FIG. 32, an amusement ride infrastructure 1000E includes a travel surface 210 defined by the support layer 205 for supporting one or more vehicles 100. The travel surface 205 is inclined (e.g., with respect to ground) at an angle θ of between about 2° and about 45°, preferably about 7° to mimic a pinball game surface. The amusement ride infrastructure 1000E includes a pinball themed region 1005F that covers substantially all of the amusement ride infrastructure 1000E or is part of the multi-themed region ride infrastructure 1000D described above. The pinball themed region 1005F includes multiple course diverters 1300 and vehicle advancers 1400 arranged to move or guide the vehicles 100 along the travel surface 210 (e.g. a large-scale pinball table). For example, a vehicle 100 may be guided down a path by a course diverter 1300 toward one or mere vehicle advancers 1400 that move the vehicle 100 in an unexpected direction toward another path. In some examples, the course diverters 1300 are configured as pinball flippers 1300A to deflect vehicles. In additional examples, one or more course diverters 1300 are configured as spinners 1300B to deflect and spin a vehicle 100 that bumps into the spinner 1300B. Other types of course diverters 1300 are possible as well. A conveyer belt 1350 may be used to carry vehicles 100 from a loading area 1200 to the top end of the travel surface 210 (e.g., top of the pinball game surface). The conveyer belt 1350 may be used in any configuration to move vehicles 100 between locations. The amusement ride infrastructure 1000E may also include one or more water devices 1140 (e.g., water guns, whipping snakes, geysers, whirly-birds, water bomb launchers, show sprayers, etc.) that may allow spectators to spray passing riders with water.

The amusement park water ride system 10, 1000 described above advantageously allow riders to experience the fun of water with the comfort and safety of being on a supported surface (e.g. in contrast to deeper water having drowning hazards or elevated rides, like roller coasters). In the examples illustrated in FIGS. 28-31, participants drive or race multiple vehicles 100 around the track 1000 and bump into each other. One or more people can drive each vehicle 100. The participants may all start and finish at the same time or participants may individually be changed out at the passenger loading/unloading area 1200. Vehicles 100 equipped with water guns 140 allow riders to direct streams of water towards each other. In some examples, the track 1000 is equipped with water devices 1140 (e.g., water guns) rotatable about a range of motion that allows spectators to spray passing riders with water and providing a family entertainment event. Vehicle advancers 1400 may be used to direct and/or provide obstacles for the vehicles 100.

A number of implementations have been described. Nevertheless, it will be understood that various modifications may be made without departing from the spirit and scope of the disclosure. For example, the valve element operator may be separate from the valve element. Also, the compliant flap employed to assist in containing the cushion of water beneath the vehicle undersurface may be formed of multiple flap elements. The amusement ride systems 10, 1000 described herein may be used to transport people and/or goods from one place to another. It may also be used as a transportation system. Accordingly, other implementations are within the scope of the following claims.

What is claimed is:

1. An amusement ride vehicle for maneuvering over a travel surface having a cushion of water, the vehicle comprising:

a vehicle body defining a vehicle undersurface disposed for travel generally along the travel surface;

at least one drive assembly housed by the vehicle body and comprising a driven wheel disposed for selective engagement with the travel surface to maneuver the vehicle generally along the travel surface;

wherein the at least one drive assembly operates between a neutral state having the driven wheel disengaged from the travel surface, a forward drive state having the driven wheel engaged with the travel surface and driven in a forward direction, and a reverse drive state having the driven wheel engaged with the travel surface and driven in a reverse direction.

2. The amusement ride vehicle of claim 1, wherein the at least one drive assembly comprises a pivot link pivotally coupled to the vehicle body, the driven wheel mounted on the pivot link, wherein pivoting the pivot link changes an operation state of the at least one drive assembly.

3. The amusement ride vehicle of claim 1, wherein the at least one drive assembly comprises:

a pivot link pivotally coupled to the vehicle body and defining a substantially V-shaped receiver configured to receive an engagement feature of a respective steering element, the driven wheel mounted on the pivot link;

wherein pivoting the steering element moves the engagement feature along the substantially V-shaped receiver, causing pivoting of the pivot link and changing an operation state of the at least one drive assembly.

4. The amusement ride vehicle of claim 1, wherein the wheel is concentrically mounted about a motor for rotation about the motor.

5. The amusement ride vehicle of claim 1, further comprising a passenger seat having a back support portion disposed at an angle forward off vertical of between about 5° and about 40°, for shifting a center of gravity of a user substantially near or over the vertical center of the vehicle.

6. The amusement ride vehicle of claim 5, wherein the back support portion of the passenger seat is disposed at an angle forward off vertical of about 10°.

7. The amusement ride vehicle of claim 1, wherein the undersurface of the vehicle body includes an edge portion having an edge surface arranged at an angle with the undersurface of between about 10° and about 60°.

8. The amusement ride vehicle of claim 7, wherein the edge surface is arranged at an angle with the undersurface of about 30°.

9. An amusement ride vehicle for maneuvering over a travel surface having a cushion of water, the vehicle comprising:

a vehicle body defining a vehicle undersurface disposed for travel generally along the travel surface;

right and left joysticks pivotally coupled to the vehicle body for pivoting between forward, neutral, and rearward positions; and right and left drive assemblies associated with the respective right and left joysticks, the right and left drive assemblies housed by the vehicle body and configured to maneuver the vehicle generally along the travel surface, each drive assembly comprising:

a pivot link pivotally coupled to the vehicle body and defining a substantially V-shaped receiver configured to receive an engagement feature of the respective joystick; and a driven wheel disposed on the pivot link for selective engagement with the travel surface;

wherein each drive assembly operates between a neutral operation state having the driven wheel out of engagement with the travel surface, a forward drive operation state having the driven wheel moved into engagement with the travel surface and driven in a forward direction, and a reverse drive operation state having the driven wheel moved into engagement with the travel surface and driven in a reverse direction, as pivoting of the respective joystick moves the engagement feature along the substantially V-shaped receiver, causing pivoting of the pivot link and changing an operation state of the respective drive assembly among the neutral operation state, the forward drive operation state, and the reverse drive operation state.

10. The amusement ride vehicle of claim 9, wherein the wheel is concentrically mounted about a motor for rotation about the motor.

11. The amusement ride vehicle of claim 9, further comprising a passenger seat having a back support portion disposed at an angle forward off vertical of between about 5° and about 40°, for shifting a center of gravity of a user substantially over the vertical center of the vehicle.

12. The amusement ride vehicle of claim 11, wherein the back support portion of the passenger seat is disposed at an angle forward off vertical of about 10°.

13. The amusement ride vehicle of claim 12, wherein the undersurface of the vehicle body includes an edge portion having an edge surface arranged at an angle with the undersurface of between about 10° and about 60°.

14. The amusement ride vehicle of claim 13, wherein the edge surface is arranged at an angle with the undersurface of about 30°.

15. A method of conveying an amusement ride vehicle generally along a travel surface, the method comprising:

placing the vehicle on an amusement ride infrastructure defining the travel surface, the vehicle comprising a vehicle body defining a vehicle undersurface disposed for travel generally along the travel surface; and delivering a pressurized flow of water through the travel surface into a confined region defined between the vehicle undersurface and the travel surface, the pressurized flow of water into and through the confined region creating a cushion of water to separate the vehicle undersurface from the travel surface; and maneuvering the vehicle over the travel surface by manipulating a steering element to alter an operation state of at least one drive assembly housed by the vehicle body, the at least one drive assembly comprising a driven wheel disposed for selective engagement with the travel surface to maneuver the vehicle generally along the travel surface;

wherein the at least one drive assembly operates between a neutral operation state having the driven wheel out of engagement with the travel surface, a forward drive operation state having the driven wheel moved into engagement with the travel surface and driven in a forward direction, and a reverse drive operation state having the driven wheel moved into engagement with the travel surface and driven in a reverse direction.

16. The method of claim 15, further comprising pivoting a pivot link of the at least one drive assembly to change an operation state of the at least one drive assembly, the driven wheel mounted on the pivot link.

17. The method of claim 16, further comprising pivoting a steering element having an engagement feature received by a substantially V-shaped receiver defined by the pivot link; wherein pivoting the steering element moves the engagement feature along the substantially V-shaped receiver, causing pivoting of the pivot link and changing an operation state of the at least one drive assembly among the neutral operation state, the forward drive operation state, and the reverse drive operation state.

18. The method of claim 15, further comprising positioning a user in a passenger seat having a back support portion disposed at an angle forward off vertical of between about 5° and about 40°, for shifting a center of gravity of the user substantially over the vertical center of the vehicle.

19. The method of claim 18, comprising positioning a user in the passenger seat at an angle forward off vertical of about 10°.

20. The method of claim 15, wherein the pressurized flow of water is delivered through a plurality of selectively disposed supply valves, each supply valve of the plurality of supply valves comprising:

a supply valve body defining at least one inlet port, an exit port, and an interior surface defining a water flow passageway between the at least one inlet port and the exit port and a valve seat, the exit port being exposed at the travel surface;

a supply valve element disposed within the water flow passageway for movement between a first position in sealing engagement with the valve seat and a second position spaced from the valve seat for permitting pressurized flow of water through the exit port; and a supply valve element operator extending above a plane of the travel surface in a position for contact with a vehicle passing over the exit port, vehicle contact with the supply valve element operator causing movement of the supply valve element from the first position to the second position, permitting pressurized flow of water through the exit port into the confined region defined between the vehicle undersurface and the travel surface.

21. The method of claim 15, further comprising maneuvering the vehicle along the travel surface through at least one themed region of the amusement ride infrastructure.

* * * * *